US008985201B2

(12) United States Patent
Begnaud et al.

(10) Patent No.: US 8,985,201 B2
(45) Date of Patent: Mar. 24, 2015

(54) ROTATION INHIBITING APPARATUS

(71) Applicant: Frank's Casing Crew and Rental Tools, Inc., Lafayette, LA (US)

(72) Inventors: Brian David Begnaud, Lafayette, LA (US); Charles Michael Webre, Lafayette, LA (US); Adam Gerard Pelletier, Youngsville, LA (US); Dougal Hugo Brown, Inverness (GB); Tom Adrian Banger, Lowestoft (GB); Peter John Lovegrove, Lowestoft (GB)

(73) Assignee: Frank's International, LLC, Houston, TX (US)

( * ) Notice: Subject to any disclaimer, the term of this patent is extended or adjusted under 35 U.S.C. 154(b) by 0 days.

(21) Appl. No.: 14/066,071

(22) Filed: Oct. 29, 2013

(65) Prior Publication Data

US 2014/0054046 A1 Feb. 27, 2014

Related U.S. Application Data

(63) Continuation of application No. 12/870,505, filed on Aug. 27, 2010, now Pat. No. 8,573,329.

(60) Provisional application No. 61/238,088, filed on Aug. 28, 2009.

(51) Int. Cl.

| | |
|---|---|
| ***E21B 19/16*** | (2006.01) |
| ***E21B 19/00*** | (2006.01) |
| ***E21B 19/08*** | (2006.01) |
| ***E21B 19/15*** | (2006.01) |
| ***E21B 19/18*** | (2006.01) |

(52) U.S. Cl.

CPC ..... *E21B 19/16* (2013.01); *E21B 19/08* (2013.01); *E21B 19/155* (2013.01); *E21B 19/161* (2013.01); *E21B 19/18* (2013.01)

USPC ..... 166/77.51; 166/77.52; 175/162; 175/220

(58) Field of Classification Search

USPC ..... 166/77.51–77.52; 175/85, 162, 220

See application file for complete search history.

(56) References Cited

U.S. PATENT DOCUMENTS

| | | | |
|---|---|---|---|
| 4,449,596 | A | 5/1984 | Boyadjieff |
| 6,527,047 | B1 | 3/2003 | Pietras |
| 2008/0060818 | A1 | 3/2008 | Bourgeois et al. |

(Continued)

OTHER PUBLICATIONS

Tesco Corporation, "Casing Running Service", Apr. 2002 (8 pages).

(Continued)

*Primary Examiner* — Giovanna Wright

(74) *Attorney, Agent, or Firm* — Osha Liang LLP

(57) ABSTRACT

Embodiments disclosed herein relate to methods and apparatus to inhibit rotation within a drilling rig. The apparatus may include a first member connected to a first component of the drilling rig, and a second member connected to the first member and connected to a second component of the drilling rig, the second component configured to move vertically with respect to the first component. The first member is configured to move vertically with respect to the second member and the first member and the second member substantially inhibit rotation between each other. The apparatus may include a rotational adjustment system, in which the rotational adjustment system is used to connect with one of the components of the drilling rig.

34 Claims, 21 Drawing Sheets

(56) References Cited

U.S. PATENT DOCUMENTS

| | | | |
|---|---|---|---|
| 2008/0093127 | A1 | 4/2008 | Angman |
| 2008/0135228 | A1 | 6/2008 | Wells et al. |
| 2008/0210063 | A1 | 9/2008 | Slack |
| 2008/0302525 | A1 | 12/2008 | Beierbach et al. |
| 2009/0314496 | A1 | 12/2009 | Begnaud et al. |

OTHER PUBLICATIONS

International Search Report and Written Opinion issued in Application No. PCT/US2010/047158, dated Apr. 21, 2011, 14 pages.

ROTATION INHIBITING APPARATUS

CROSS-REFERENCE TO RELATED APPLICATIONS

The present application is a continuation, and thereby claims benefit under 35 U.S.C. §120 from U.S. patent application Ser. No. 12/870,505 filed on Aug. 27, 2010, which claims priority, pursuant to 35 U.S.C. §119(e), to U.S. Provisional Application Ser. No. 61/238,088, filed on Aug. 28, 2009 and entitled "Rotation Inhibiting Apparatus." The priority applications are hereby incorporated by reference in their entirety.

BACKGROUND OF DISCLOSURE

1. Field of the Disclosure

Embodiments disclosed herein generally relate to methods and apparatus to assemble and/or disassemble a string of tubular members. More specifically, embodiments disclosed herein relate to an apparatus to be coupled to a tubular running tool during assembly of a string of tubular members, such as oilfield tubular members in an oilfield drilling rig.

2. Background Art

In oilfield exploration and production operations, various oilfield tubular members are used to perform important tasks, including, but not limited to, drilling the wellbore and casing a drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, such as end-to-end by threaded connections, in which a female "pin" member of a first tubular member is configured to threadably engage a corresponding male "box" member of a second tubular member. Alternatively, a casing string may be made-up of a series of male-male ended casing joints coupled together by female-female couplers. The process by which the threaded connections are assembled (e.g., screwed together) is called "making-up" a threaded connection, and the process by which the connections are disassembled is referred to "breaking-out" the threaded connection. As would be understood by one having ordinary skill, individual pieces (or "joints") of oilfield tubular members may come in a variety of weights, diameters, configurations, and lengths.

Referring to FIGS. 1A and 1B, multiple views are shown of a drilling rig 101 used to run one or more tubular members 111 (e.g., casing, drill pipe, etc.) downhole into a wellbore 113. As shown, the drilling rig 101 includes a frame structure known as a "derrick" 102, from which a traveling block 103, an elevator first gripping apparatus 105 (e.g., a casing running tool or conventional string elevator), a top drive 145, and a second gripping apparatus 107 (e.g., slip assembly or spider) may be used to manipulate (e.g., raise, lower, rotate, hold, etc.) a tubular member 111. The traveling block 103 is a device that is suspended from at or near the top of the derrick 102, in which the traveling block 103 may move up-and-down (i.e., vertically as depicted) to raise and/or lower the tubular member 111. The traveling block 103 may be a simple "pulley-style" block and may have a hook from which objects below (e.g., first gripping apparatus 105 and/or top drive 145) may be suspended.

Additionally, the first gripping apparatus 105 may be coupled below the traveling block 103 and/or the top drive 145 (shown in FIG. 1A) to selectively grab or release a tubular member 111 as the tubular member 111 is to be raised and/or lowered within and from the derrick 102. Further, the top drive 145 may include one or more guiding rails and/or a track 108 disposed adjacent to the top drive 145. The guiding rails or track 108 may be used by the top drive 145 to support and guide the top drive 145 as the top drive 145 is raised and/or lowered within the derrick 102. An example of a top drive is disclosed within U.S. Pat. No. 4,449,596, filed on Aug. 3, 1982, and entitled "Drilling of Wells with Top Drive Unit," which is incorporated herein by reference.

Typically, the first gripping apparatus 105 includes movable gripping members (e.g., slips) attached thereto and movable between an open position and a closed position. In the closed position, the first gripping apparatus 105 supports the tubular member 111 such the tubular member 111 may be lifted and/or lowered, and rotated if so equipped, e.g., using a tubular (e.g., casing) running tool connected to the quill of the top drive 145. In the open position, the first gripping apparatus 105 may release the tubular member 111 and move away therefrom to allow the tubular member 111 to be engaged with or removed from the first gripping apparatus 105 and/or the second gripping apparatus 107. For example, the first gripping apparatus 105 may release the tubular member 111 after the tubular member 111 is threadably connected to a downhole string 115 supported by the drilling rig 101.

Further, the second gripping apparatus 107 may be used to grip the downhole string 115 and suspend the downhole string 115 from the rig, e.g., from within the rotary table 109. The second gripping apparatus 107 may be disposed above the rotary table 109, or may be disposed within the rotary table 109, as shown, such as flush with the rotary table 109. As such, the second gripping apparatus 107 may be used to suspend the downhole string 115 while one or more tubular members 111 are connected or disconnected from the downhole string 115.

When assembling a downhole string 115 of tubular members 111 together, a tubular member 111 may be removed from a pipe rack 112 and pulled, or otherwise transported, towards an access opening 121, for example, a v-door, within the derrick 102 of the drilling rig 101. The tubular member 111 may be loaded onto a pipe ramp 125 adjacent to the access opening 121, in which an end stop 131 may abut an end of the tubular member 111 to support the tubular member 111 against access opening 121.

To facilitate this assembly process, a tubular handling mechanism 151, such as single joint manipulator, shown in FIGS. 2A-2C, may be used to transport the tubular member 111 into and within the derrick 102 of the drilling rig 101. For example, the tubular handling mechanism 151 may be connected to the top drive 145 and have a single joint elevator 143 attached thereto. A tubular handling mechanism 151 may be rotationally connected to a quill of the top drive 145 such that the tubular handling mechanism 151 is rotatable with respect to the quill of the top drive 145, such as rotatable about a vertical axis of the quill of the top drive 145. As such, a rotation inhibiting apparatus may be disposed between the tubular handling mechanism 151 and the rig 101, e.g., a non-rotating portion of top drive 145, to prevent rotation between the tubular handling mechanism 151 via the non-rotating portion of the top drive 145, if desired.

As shown in FIG. 2A, the single joint elevator 143 of the tubular handling mechanism 151 may grasp an end of the tubular member 111 located within an access opening 121. The tubular handling mechanism 151 may contact a shoulder of the tubular member 111 or alternatively include a slip assembly used to grasp (e.g., frictionally) the tubular member 111. As such, the tubular handling mechanism 151 may raise the tubular member 111 up into the derrick 102 and may align the tubular member 111, such as shown in FIG. 2B, with the downhole string 115, in which the tubular member 111 may threadably connect to lengthen the downhole string 115.

As such, and as shown in FIG. 2C, a tubular running tool 141 driven by a top drive 145 may be used to threadably connect the tubular member 111 to the downhole string 115. Specifically, the tubular running tool 141 may have one or more gripping members 147 that may move radially inward and outward with respect to an axis 149 of the tubular running tool 141 and/or the top drive 145 (e.g., quill of the top drive 145). Gripping members 147, such as with an internally gripping tool in FIG. 2C, may be used to grip an internal surface of the tubular member 111, and/or gripping members 147 may grip an external surface of the tubular member 111, such as with an external gripping tool shown in FIGS. 2D and 2E (shown without the typical connection of the bore of the tubular member 111 to a fluid source, but may be included without departing from the scope of the present application). As such, the quill of the top drive 145 may rotate the tubular running tool 141, thereby rotating the tubular member 111 gripped by the tubular running tool 141. During rotation, the tubular member 111 may threadably connect to the downhole string 115 to lengthen the downhole string 115. As such, as used herein, a top drive 145 may include any motor and/or powered device, such as a power swivel, that may be used to rotate a tubular member 111.

After connecting the tubular member 111 to the downhole string 115, the second gripping apparatus 107 may disengage from the downhole string 115 to enable the downhole string 115 to be lowered further downhole. As such, after lowering, the second gripping apparatus 107 may re-engage the top of the downhole string 115, such as to have another tubular member 111 connected thereto.

A reverse process, or one similar to the process described above, may be used, such as to remove one or more tubular members 111 from the drilling rig 101. As such, when removing a tubular member 111 from the drilling rig 101, the downhole string 115 may be raised into the derrick 102 to have the tubular member 111 extending above the second gripping apparatus 107 and rotary table 109. The second gripping apparatus 107 may be used to support the remainder of the downhole string 115 below the rotary table 109, in which the tubular member 111 may be threadably disconnected from the downhole string 115. For example, the tubular running tool 141 may grip the tubular member 111 and the top drive 145 may rotate the tubular member 111 to threadably disconnect the tubular member 111 from the downhole string 115. The tubular handling mechanism 151, or other handling mechanism or device, may transport the tubular member 111 out of the derrick 102 of the drilling rig 101 to have the tubular member 111, for example, placed upon the pipe rack 112.

However, when making-up or breaking-out threaded connections between a tubular member 111 and the downhole string 115, the tubular member 111 may move in a vertical direction (along the axis of the tubular member 111) with respect to the downhole string 115. For example, as a tubular member 111 is threadably connected with a downhole string 115, the tubular member 111 and the downhole string 115 may move vertically with respect to each other. Specifically, the tubular member 111 may move vertically downward with respect to the drilling rig 101 as the downhole string 115 remains relatively stationary with respect to the drilling rig 101. This movement of the tubular member 111 with respect to the downhole string 115 enables a proper engagement between the male and female threads of the threaded connection between the tubular member 111 and the downhole string 115.

As such, 151 the top drive 145, and/or the tubular running tool 141 may need to compensate and/or offset the vertical and rotational movement of the tubular member 111 with respect to the downhole string 115. Particularly, as the tubular member 111 is rotated to threadably connect to and/or disconnect from the downhole string 115, 151 the top drive 145, and/or the tubular running tool 141 will need to move vertically with the tubular member 111 to maintain proper engagement therewith. A tubular handling mechanism 151 may be mounted to a rotatable and/or rotating member (e.g., to quill of top drive 145, a sub connected thereto, and/or tubular running tool 141), but it may be desired to retain the tubular handling mechanism 151 (or other component) rotationally stationary relative to the rig. Accordingly, there exists a need to restrict rotation of a component mounted (e.g., via bearing) to a rotatable and/or rotating member while allowing vertical movement (e.g., active movement during rotation or adjustment during setup, such as owing to differing distances between a rotationally stationary portion of a top drive rig and the component to be restricted from rotation).

SUMMARY OF INVENTION

In one aspect, embodiments disclosed herein relate to an apparatus to inhibit rotation within a drilling rig. The apparatus includes a first member connected to a first component of the drilling rig, and a second member connected to the first member and connected to a second component of the drilling rig, the second component configured to move vertically with respect to the first component. The first member is configured to move vertically with respect to the second member and the first member and the second member substantially inhibit rotation between each other.

In one aspect, embodiments disclosed herein relate to an system to inhibit rotation within a drilling rig. The system includes a drilling rig, in which the drilling rig includes a top drive having a vertical axis defined therethrough and a tubular handling mechanism supported from a quill of the top drive. The rotation inhibiting apparatus includes a first member connected to a rotationally stationary component of the top drive and a second member connected to the first member and to the tubular handling mechanism. The first member is movable with respect to the second member in a direction along the vertical axis of the top drive and the first member and the second member are configured to remain rotationally stationary with respect to each other about the vertical axis of the top drive.

In one aspect, embodiments disclosed herein relate to an apparatus to inhibit rotation of a component of a top drive. The apparatus includes a first member and a second member connected to each other, in which the first member and the second member connect between a component of a drilling rig, the component of the drilling rig remaining rotationally stationary with respect to an axis of the top drive, and a component connected to a quill of the top drive. At least one of the first member and the second member is configured to move vertically with respect to the drilling rig, and the first member and the second member are configured to remain rotationally stationary with respect to each other about the axis of the tubular running tool.

In one aspect, embodiments disclosed herein relate to a method to inhibit rotation within a drilling rig. The method includes coupling a first member of a rotation inhibiting apparatus to a first component of a drilling rig, coupling a second member of the rotation inhibiting apparatus to a second component of the drilling rig, the second component configured to move vertically with respect to the first component and configured to rotate with respect to the first component, and connecting the first member and the second member of the rotation inhibiting apparatus to each other such that the first member is able to move vertically with respect to the second member within the drilling rig and the first member and the second member substantially inhibit rotation between each other.

In one aspect, embodiments disclosed herein relate to a method to at least one of make-up and break-out a threaded connection with a string of tubular members. The method includes rotating a tubular member with respect to the string of tubular members with a tubular running tool and moving a first member of a rotation inhibiting apparatus with respect to a second member of the rotation inhibiting apparatus along an axis of the tubular running tool, the rotation inhibiting apparatus being coupled between the tubular handling mechanism and a component of a drilling rig.

In one aspect, embodiments disclosed herein relate to an apparatus to inhibit rotation within a drilling rig. The apparatus includes a member having a first end and a second end, the first end of the member connected to at least one bail ear of a top drive of the drilling rig, and the second end of the member connected to a component rotationally connected to a quill of the top drive.

In one aspect, embodiments disclosed herein relate to a method to inhibit rotation within a drilling rig. The method includes coupling a first end of a member of a rotation inhibiting apparatus to at least one bail ear of a top drive of the drilling rig, and coupling a second end of the member of the rotation inhibiting apparatus to a component rotationally coupled to a quill of the top drive of the drilling rig. The quill is configured to rotate about a rotational axis of the top drive.

In one aspect, embodiments disclosed herein relate to an apparatus to inhibit rotation within a drilling rig. The apparatus includes a member having a first end and a second end and a rotational adjustment system. The first end of the member connected to a first component of the drilling rig, and the second end of the member connected to the rotational adjustment system, the rotational adjustment system connected to a second component of the drilling rig.

In one aspect, embodiments disclosed herein relate to a method to inhibit rotation within a drilling rig. The method includes coupling a first end of a member of a rotation inhibiting apparatus to a first component of the drilling rig, coupling a second end of the member of the rotation inhibiting apparatus to a rotational adjustment system, and coupling the rotational adjustment system to a second component of the drilling rig.

Other aspects and advantages of the invention will be apparent from the following description and the appended claims.

DETAILED DESCRIPTION

Figure 1A:
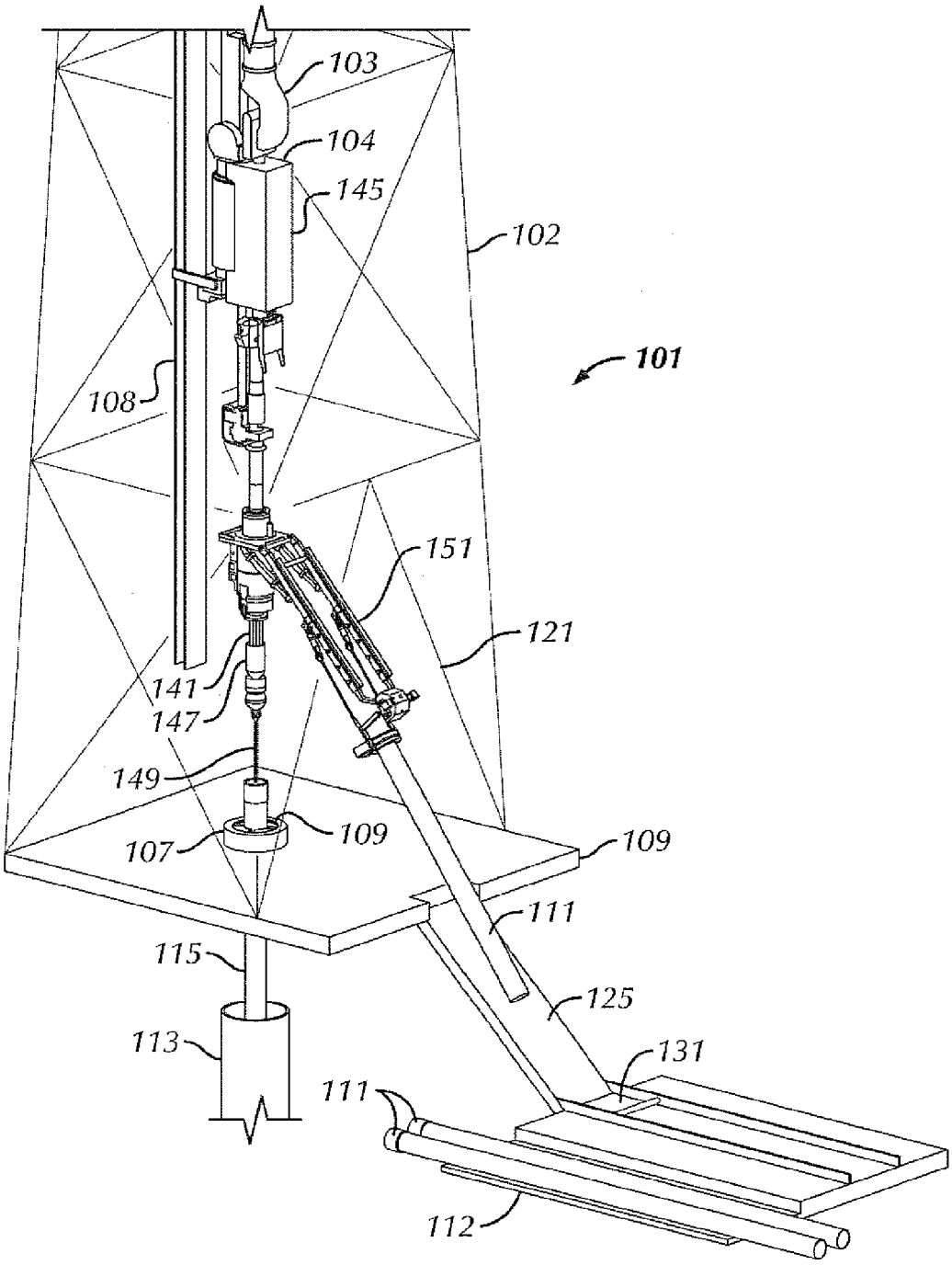
FIGS. 1A and 1B show perspective views of a drilling rig.
Figure 1B:
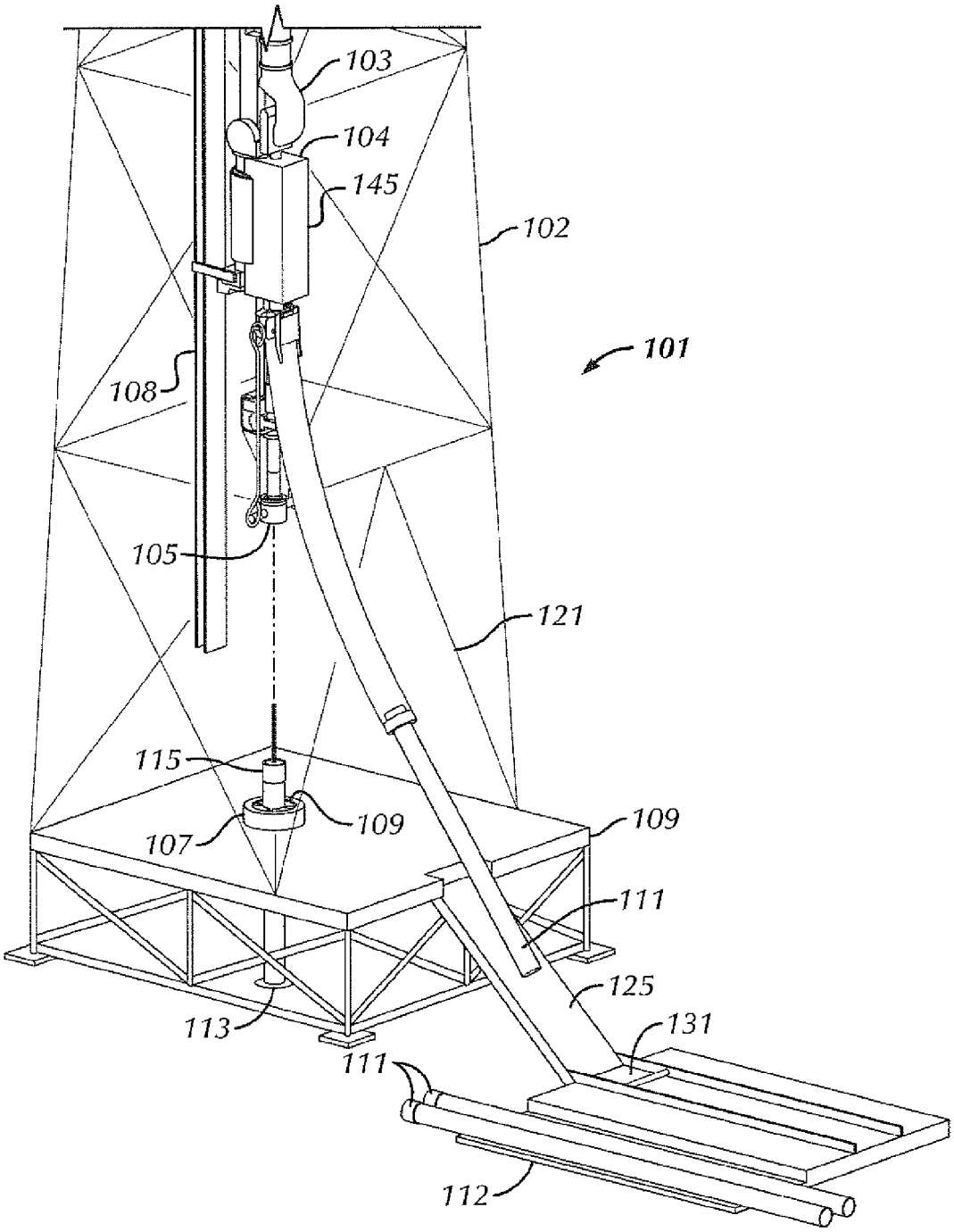

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description.

In various aspects disclosed herein, embodiments disclosed herein generally relate to an apparatus to inhibit rotation between one or more components of a drilling rig. For example, embodiments disclosed herein relate to an apparatus to inhibit rotation between a tubular handling mechanism, a tubular running tool, a top drive, and/or a rotationally stationary member disposed of a drilling rig (e.g., housing of a top drive, traveling block or derrick of the drilling rig). The tubular handling mechanism, the tubular running tool, and/or the top drive may be disposed within a drilling rig and may be used to engage and transport tubular members into, out-of, and/or within the drilling rig. For example, the tubular handling mechanism may be used to move a tubular member into the drilling rig, remove the tubular member from the drilling rig, and/or move the tubular member vertically into and/or out-of a wellbore adjacent to the drilling rig with respect to a floor of the drilling rig. Further, the tubular running tool may be used to engage a tubular member within a drilling rig, and the top drive may be used to rotate a tubular member within the drilling rig, such as when making-up and breaking-out threaded connections with a string of tubular members.

As such, a rotation inhibiting apparatus in accordance with embodiments disclosed herein may be disposed within a drilling rig and connected to a component to be restricted from rotation, e.g., a tubular handling mechanism, in which the rotation inhibiting apparatus may increase the ability of the tubular handling mechanism, to control the tubular members. Particularly, the apparatus may be used to inhibit rotation from adversely affecting the performance of the drilling rig, such as the tubular running tool, the tubular handling mechanism, and/or the top drive. Consequently, the rotation inhibiting apparatus may prevent damage to one or more components of the drilling rig, may prevent damage to the tubular members, and/or may accelerate the process when controlling and managing tubular members within the drilling rig. For example, in one embodiment, the rotation inhibiting apparatus may prevent a tubular handling mechanism from rotating with respect to a drilling rig while making-up a threaded connection within a drill string.

Thus, in one aspect, the rotation inhibiting apparatus may include a first member and a second member connected to each other. The first member of the rotation inhibiting apparatus may connect to a component and/or surface of the drilling rig, in which the component and/or surface remains rotationally stationary with respect to the drilling rig. For example, in an embodiment in which the drilling rig includes a top drive, the first member of the rotation inhibiting apparatus may connect to a component, such as a bail ear or the housing, of the top drive. The second member may connect to the component to be restricted from rotation, e.g., a tubular handling mechanism disposed within the drilling rig, wherein the tubular handling mechanism is desired to be retained rotationally stationary relative to the drilling rig.

Further, the first member and the second member of the rotation inhibiting apparatus may be connected to each other such that the first member and second member may move vertically with respect to each other. For example, in an embodiment in which the drilling rig includes a tubular running tool and a top drive, the first member and the second member may move with respect to each other in a direction parallel to an axis of the tubular running tool and/or the top drive. As such, through this moveable connection between the first member and the second member, the rotationally stationary component of the drilling rig connected to the first member and the tubular handling mechanism connected to the second member may vertically move with respect to each other while connected via the rotation inhibiting apparatus, thereby enabling vertical movement between the tubular handling mechanism and the drilling rig.

Furthermore, the first member and the second member of the rotation inhibiting apparatus may remain rotationally stationary with respect to each other, such as about the axis of the tubular running tool and/or top drive. As such, this arrangement may enable the first member and the second member to inhibit rotation from being transferred between each other, rotation occurring about the axis of the tubular running tool. For example, rotational movement may be received by the tubular handling mechanism, such as by having the tubular handling mechanism or portions thereof contact a tubular member, when the tubular running tool is rotating the tubular member. Because the first member and the second member of the rotation inhibiting apparatus remain rotationally stationary with respect to each other, the second member of the rotation inhibiting apparatus may inhibit rotation of the first member, and thus anything connected thereto. For example, rotational movement received by and/or imparted to a tubular handling mechanism may be inhibited, at least partially, by stabilizing against a rotationally stationary component using the rotation inhibiting apparatus, thereby preventing rotational movement across the tubular handling mechanism and the rotationally stationary component.

As used herein, "connected" may refer to not only having two or more elements directly attached to each other, but connected may additionally refer to having two or more elements indirectly attached to each other. For example, as mentioned above, the rotation inhibiting apparatus may have a first member and a second member connected to each other. As such, it should be understood that the present disclosure contemplates not only having the first member and the second member directly attached to each other, but the present disclosure additionally contemplates other structures and/or arrangements for the rotation inhibiting apparatus, such as by having a third member disposed between the first member and the second member, in which the first member and the second member are connected to each other through the third member.

Figure 3A:
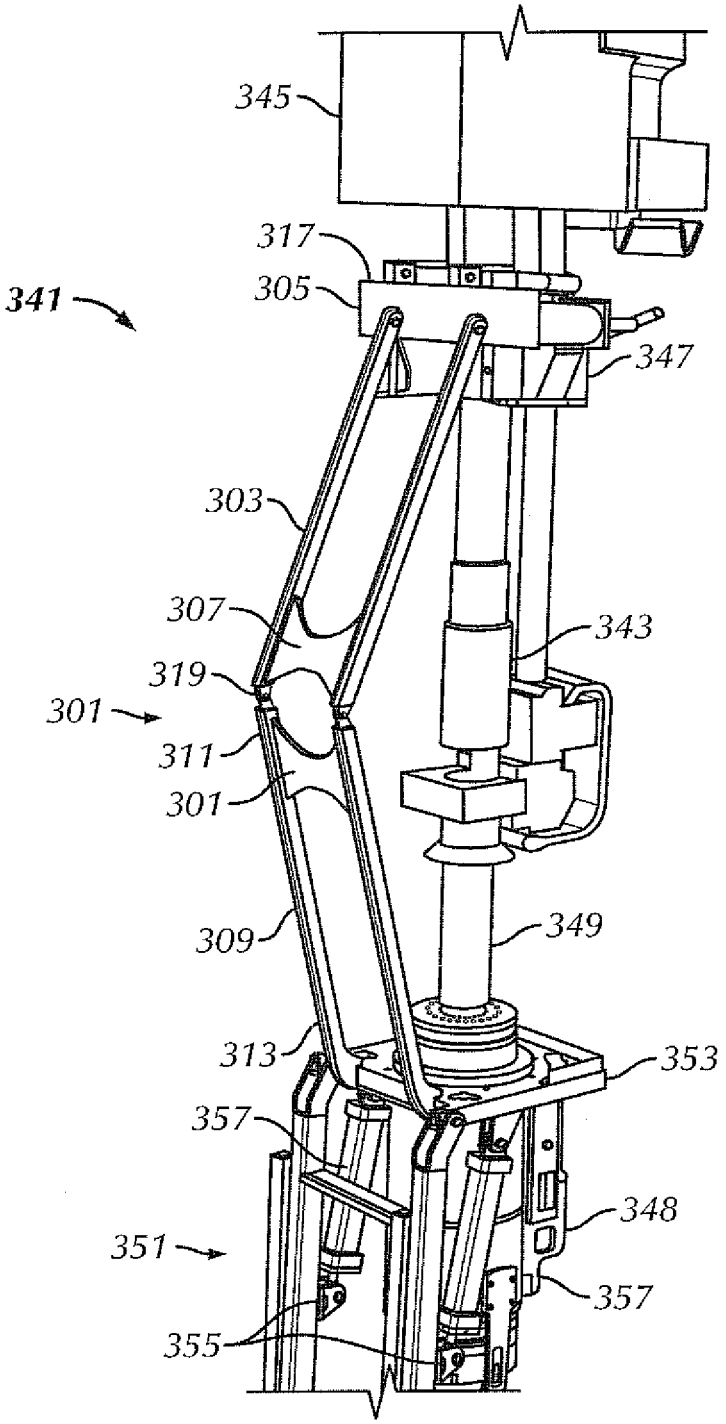
FIGS. 3A-3C show multiple views of a rotation inhibiting apparatus connected to a tubular handling mechanism in accordance with embodiments disclosed herein.
Figure 3B:
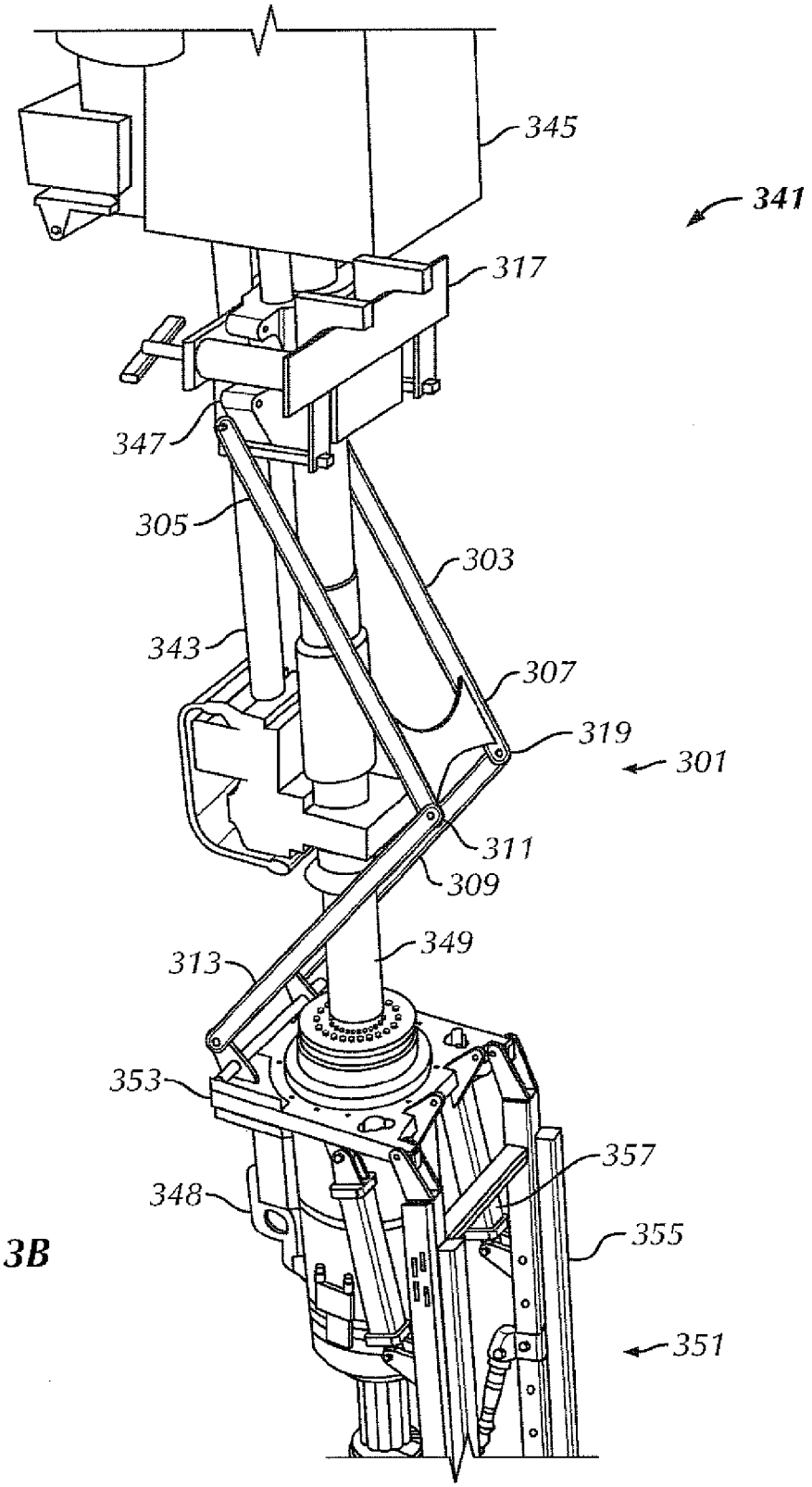
Figure 3C:
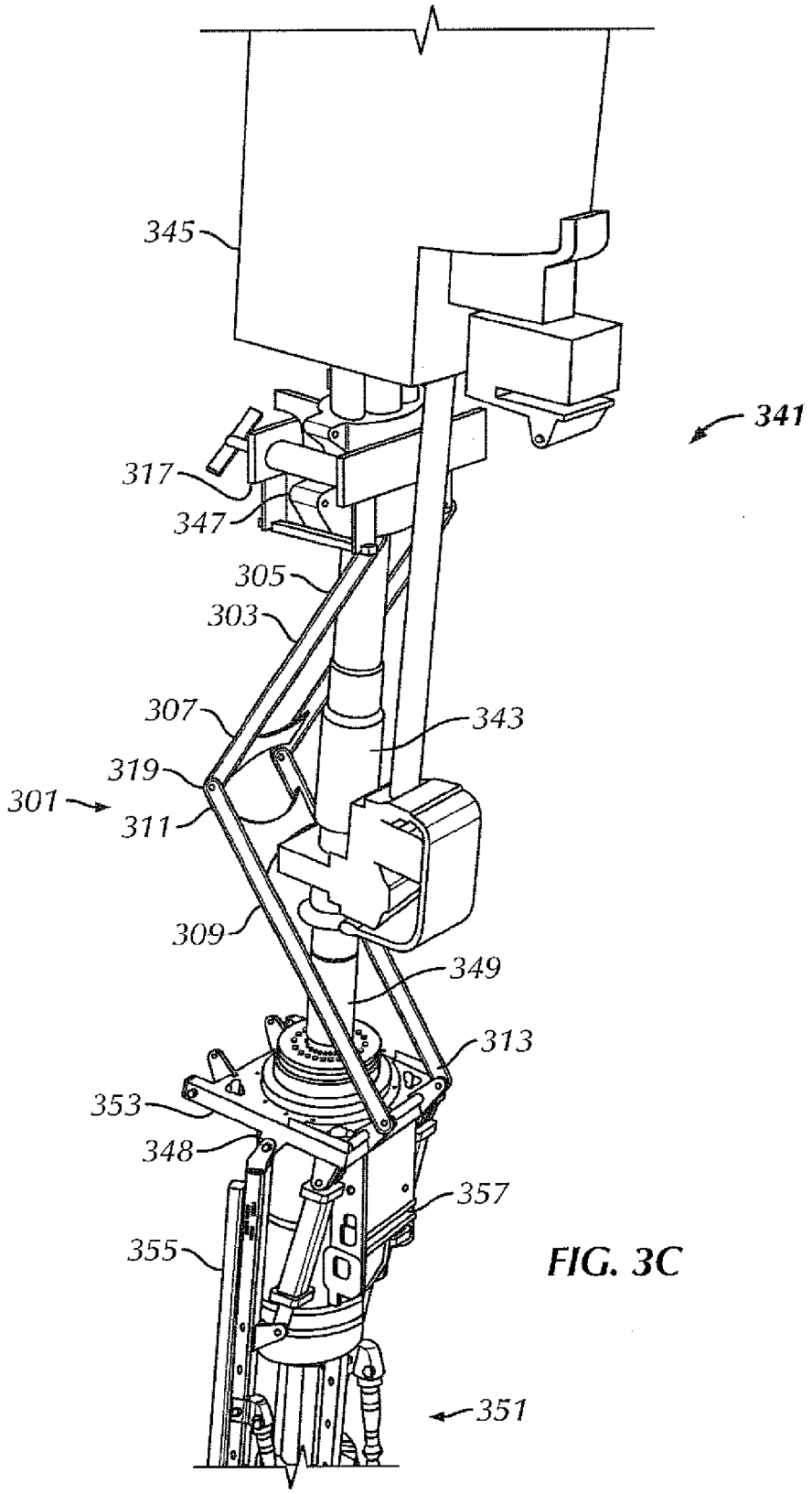

Referring now to FIGS. 3A-3C, multiple perspective views of a rotation inhibiting apparatus 301 connected to a tubular handling mechanism 351 in accordance with embodiments disclosed herein are shown. Specifically, FIGS. 3A-3C show multiple arrangements of the rotation inhibiting apparatus 301 connected to a tubular handling mechanism 351 in accordance with embodiments disclosed herein. Those having ordinary skill in the art will appreciate that, though a rotation inhibiting apparatus is shown as disposed adjacent to a tubular handling mechanism, the present disclosure contemplates using a rotation inhibiting apparatus in accordance with embodiments disclosed herein to inhibit rotation of any component that may have undesired rotation imparted thereto. For example, in other embodiments, a rotation inhibiting apparatus may be used to inhibit rotation from being imparted to a portion of a top drive, such as a rotationally independent sub connected to a quill of a top drive, in accordance with embodiments disclosed herein.

Continuing, as discussed above, a tubular handling mechanism may be used to engage and transport tubular members into, out-of, and/or within a drilling rig, and a top drive quill may be used to engage and rotate tubular members within the drilling rig. In the illustrated embodiment, a tubular running tool 341 includes a mandrel 349, and the top drive 345 includes a quill 343. The mandrel 349 and the quill 343 may be connected to each other, such as through a threaded connection, thereby enabling the mandrel 349 to be operationally (e.g., rotationally) connected to the top drive 345. For example, the top drive 345 may be used to rotate to the mandrel 349 about a longitudinal axis thereof.

Further, the tubular running tool 341 may include one or more gripping members, in which the gripping members may be operationally connected to the mandrel 349. For example, the gripping members may be rotated by the top drive via the mandrel 349 while used to selectively engage a tubular member. Specifically, the gripping members may be selectively deployable to engage an inner surface of a tubular member. Those having ordinary skill in the art, however, will appreciate that the present disclosure is not so limited to using gripping members to engage an inner surface of a tubular member, as the present disclosure contemplates using other gripping devices to engage a tubular member, such as engaging the tubular member on an outer surface thereof. For example, other gripping apparatuses have gripping members to grip an internal or external surface of a tubular member in accordance with embodiments disclosed herein are disclosed within U.S. patent application Ser. No. 11/912,665, filed on Oct. 25, 2007, and entitled "Gripping Tool," which is incorporated herein by reference As such, rotation of the mandrel 349 generated by the top drive 345 may be transferred to a tubular member by having the gripping members, operationally connected to the mandrel 349, engage the tubular member. When the gripping members engage the tubular member, the top drive 345 may be used to rotate the tubular member. This may enable the top drive 345 to make-up and/or break-out a threaded connection between the tubular member and a string of tubular members supported by the drilling rig and/or this may enable the top drive 345 to rotate the string of tubular members, for example, such as when drilling (or reaming) with a drill bit (or reaming shoe) on the distal end of the tubular string.

Furthermore, the tubular running tool 341 may include a compensator 348, e.g., thread compensator. In this embodiment, the compensator 348 is operationally connected to the mandrel 349, in which the compensator 348 enables the lower end of the tubular running tool 341 to move vertically with respect to the top drive 345. For example, when making-up and/or breaking-out a threaded connection with the top drive 345 and the tubular running tool 341, the tubular member engaged by the tubular running tool 341 may move vertically along an axis thereof during make-up of the threaded connection (e.g., when axial movement is necessary between a male and female member when properly making-up a threaded connection). As such, the compensator 348 may enable the lower end of the tubular running tool 341 to move along an axis thereof when engaged with the tubular member while the top drive 345, and quill 343 connected thereto, remain relatively stationary vertically. The compensator, such as the thread compensator, may be formed integrally with the top drive and/or quill, such as disclosed within U.S. patent application Ser. No. 12/414,645, filed on Mar. 30, 2009, and entitled "Multipurpose Tubular Running Tool," which is incorporated herein by reference, or may be formed as a separate sub, such as a sub connected between the quill of a top drive and a gripping apparatus.

As discussed above, the tubular handling mechanism 351 may be used to move a tubular member into the drilling rig, remove the tubular member from the drilling rig, and/or move the tubular member vertically into and/or out-of axial alignment with a tubular string and/or a wellbore. In the depicted embodiment, the tubular handling mechanism 351 may include a plate 353, in which the plate 353 may be disposed about the tubular running tool 341. The plate 353 may be used to connect the tubular handling mechanism 351 to the tubular running tool 341, such as by having the tubular handling mechanism 351 connected to a portion of the tubular running tool 341 rotationally independent of the mandrel 349. As used herein, rotationally independent refers to when a first member is rotationally independent from one or more other members, in which the first member may not rotate, or may rotate at a different speed at least, with respect to the one or more other members if either of either the first member or the one or more other members has rotation imparted thereto. As such, in one embodiment, because the tubular handling mechanism 351 is rotationally independent from the mandrel 349, the tubular handling mechanism 351 may not rotate with the mandrel 349 when the mandrel 349 is rotationally driven by the top drive 345. Further, those having ordinary skill in the art will appreciate that the present disclosure is not so limited to the structure and arrangement to connect the tubular handling mechanism to the tubular running tool, as shown, as the present disclosure contemplates having other structures and/or arrangements for connecting the tubular handling mechanism and the tubular running tool to each other in accordance with embodiments disclosed herein.

Figure 2A:
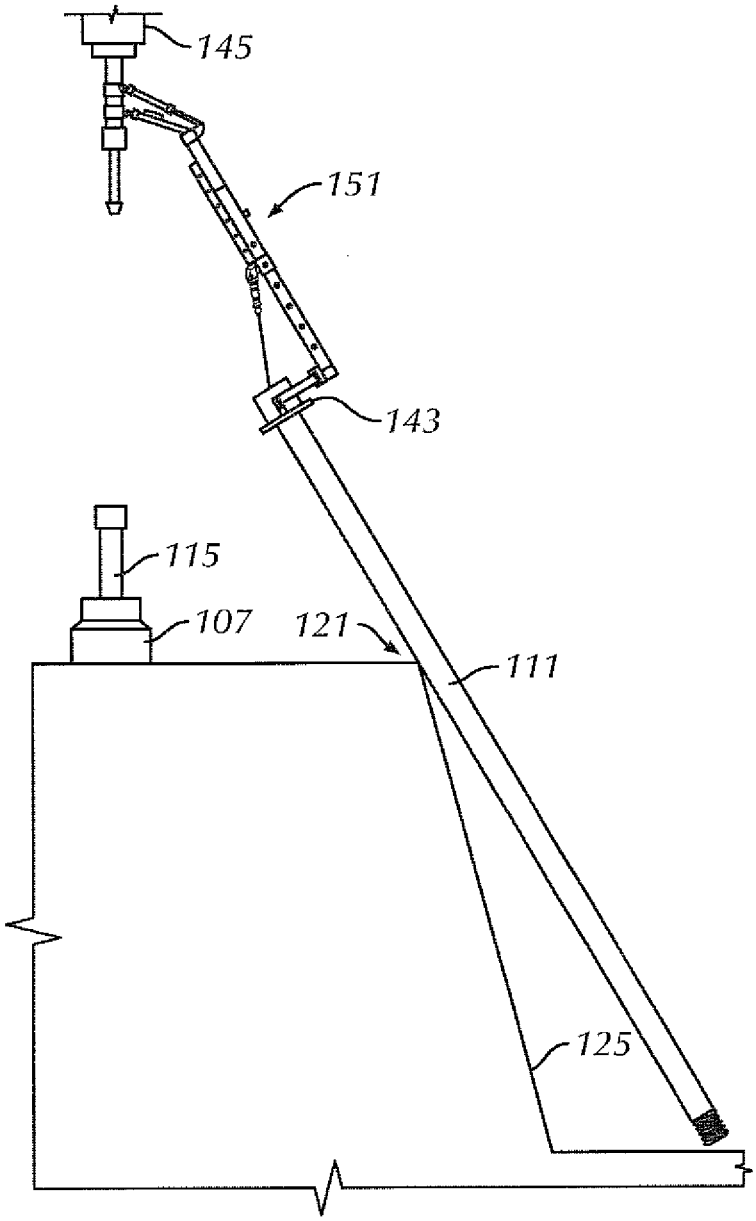
FIGS. 2A-2C show multiple views of a tubular handling mechanism disposed within a drilling rig.
Figure 2B:
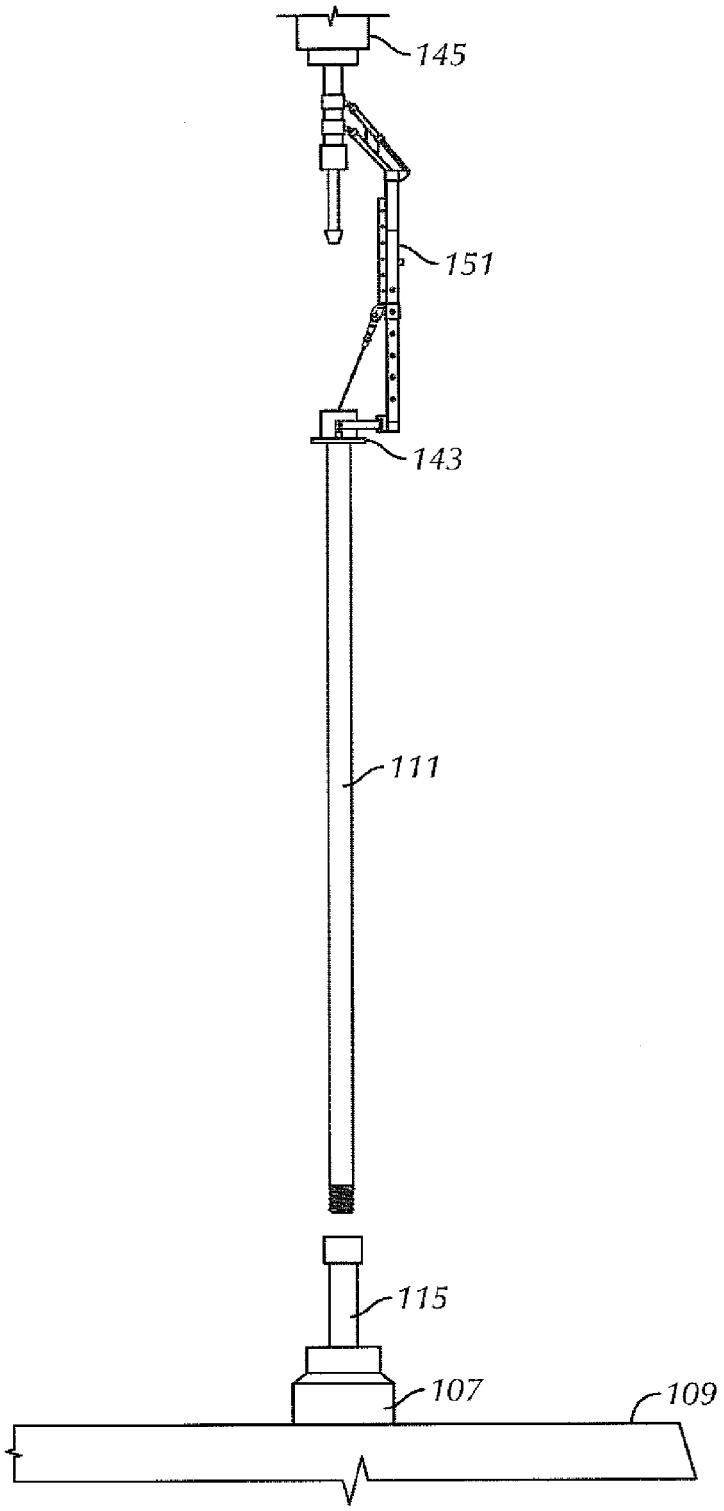
Figure 2C:
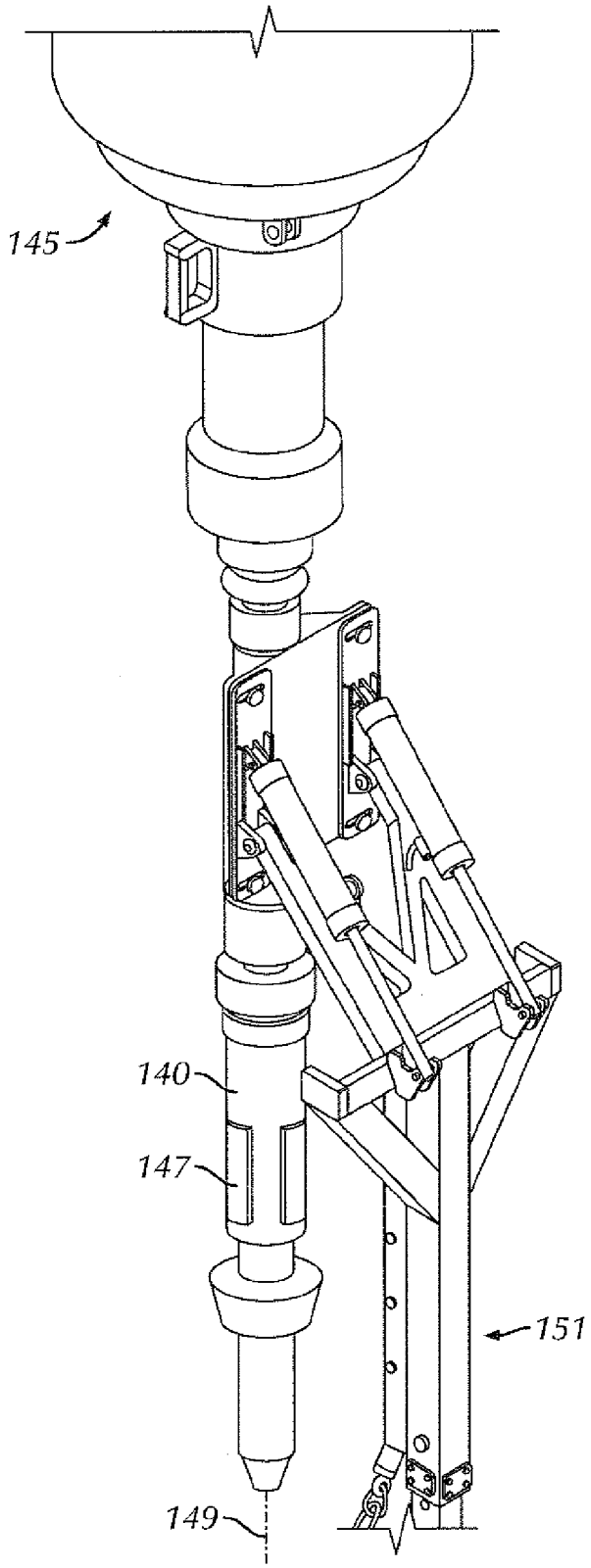
Figure 2D:
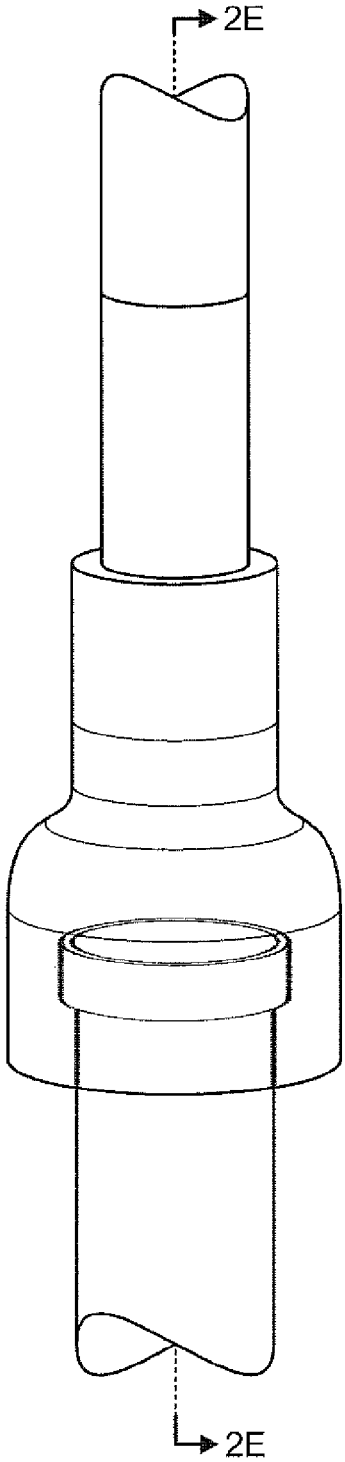
FIGS. 2D and 2E show multiple views of an external gripping tool.
Figure 2E:
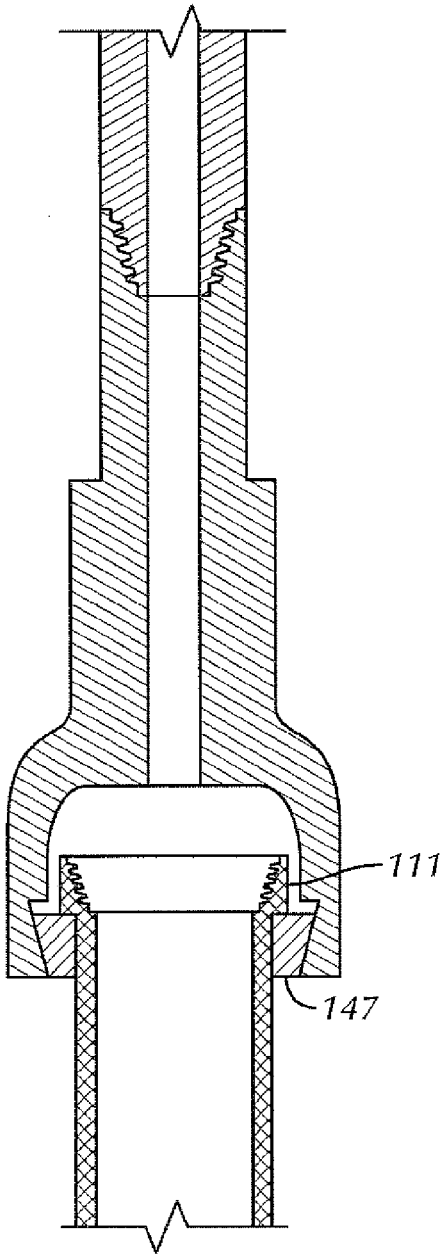

Furthermore, the tubular handling mechanism 351 may include one or more arms 355 with an elevator, such as a single joint elevator (e.g., 143 within FIGS. 2A and 2B), attached to an end thereof. An arm 355 may be extendable and/or may be pivotally connected with the tubular running tool 341, such as by having the arm 355 pivotally connected to the plate 353. Further, the tubular handling mechanism 351 may include one or more actuators 357 connected to an arm(s), such as by having the actuator(s) 357 connected between the plate 353 and the arm(s) 355. As such, the actuator(s) 357 may be used to provide movement to the arm(s) 355, as the actuator(s) 357 may be electrically actuated, hydraulically actuated, pneumatically actuated, mechanically actuated, or the like, such as by having piston cylinders.

The tubular handling mechanism 351 may be used to engage and transport tubular members into, out-of, and/or within the drilling rig. For example, the elevator connected to the depicted arms 355 of the tubular handling mechanism 351 may be used to engage a tubular member, such as the upper end of the tubular member, and transport the tubular member through an access opening (e.g., a v-door) of a drilling rig. As the arm(s) 355 of the tubular handling mechanism may be pivotally attached to the tubular running tool 341, the tubular handling mechanism 351 may align the tubular member with a string of tubular members supported by the drilling rig.

Those having ordinary skill in the art will appreciate that the present disclosure is not so limited to the structure and arrangement of the tubular handling mechanism as shown, as the present disclosure contemplates having other structures and/or arrangements for a tubular handling mechanism in accordance with embodiments disclosed herein. For example, another tubular handling mechanism that may be used in accordance with embodiments disclosed herein is disclosed within U.S. patent application Ser. No. 11/470,910, filed on Sep. 7, 2006, entitled "Light-Weight Single Joint Manipulator Arm," and published as U.S. Patent Publication No. 2008/0060818 on Mar. 13, 2008, which is incorporated herein by reference. Further, a tubular handling mechanism, a tubular running tool, a thread compensator and/or a top drive, in accordance with embodiments disclosed herein is disclosed within the "Multipurpose Tubular Running Tool" U.S. patent application, which is described above and incorporated by reference.

Further, those having ordinary skill in the art will appreciate that the present disclosure is not so limited to the structure and arrangement of the tubular running tool, as shown and described with respect to FIGS. 3A-3C, as the present disclosure contemplates having other structures and/or arrangements for a tubular running tool to engage and rotate one or more tubular members in accordance with embodiments disclosed herein. For example, in one or more embodiments, a tubular running tool in accordance with embodiments disclosed herein may include a fluid assembly used to provide fluid therethrough and into a string of tubular members.

Referring still to FIGS. 3A-3C, the tubular handling mechanism 351 may have the rotation inhibiting apparatus 301 connected thereto. As discussed above, the rotation inhibiting apparatus 301 may include a first member 303 and a second member 309, in which the first member 303 and the second member 309 are connected to each other. Specifically, the first member 303 and the second member 309 may be connected to each other such that the first member 303 and the second member 309 may move vertically with respect to each other, such as along the axis of the tubular running tool 341 and the top drive 345.

As such, in this embodiment, the first member 303 includes a first end 305 and a second end 307, and the second member 309 includes a first end 311 and a second end 313. As shown, the second end 307 of the first member 303 may connect to the first end 311 of the second member 309. Particularly, in this embodiment, the second end 307 of the first member 303 may connect to the first end 311 of the second member 309 using a pivot 319. This connection may enable the first member 303 to rotate with respect to the second member 309, such as about the rotational axis of the top drive 345.

Further, the first end 305 of the first member 303 may connect to a relatively rotationally stationary component of the drilling rig. Specifically, the first end 305 of the first member 303 may connect to a component of the drilling rig, in which the component may remain rotationally stationary, such as with respect to the axis of the tubular running tool 341 and/or the top drive 345. For example, as shown in FIGS. 3A-3C, the first end 305 of the first member 303 may connect to one or more ears 347 (e.g., elevator link ears or bail ears) of the top drive 345. As used herein, bail ears may be used to refer generally to ears of a top drive, such as either elevator link ears or bail ears of a top drive. As such, a rotation inhibiting apparatus may be used to inhibit rotation between two or more components of a drilling rig, such as by transferring torque between the two components of the drilling rig (discussed more below).

In this embodiment, the rotation inhibiting apparatus 301 may include a support structure 317, such as a top drive bracket support structure shown in FIGS. 3A-3C, in which the support structure 317 may connect to one or more of the bail ears 347 of the top drive 345. The first end 305 of the first member 303 may connect, such as pivotally connect, to the support structure 317, thereby enabling the first member 303 to connect to the bails ears 347 of the top drive 345. As shown, the support structure 317 may be disposed about one or more of the bail ears 347, in which the support structure 317 may releasably connect to the top drive 345. As such, this arrangement of the support structure 317 inhibits rotation between the first member 303 and the support structure 317 about the rotational axis of the top drive 345.

The connection between the first member 303 and the rotationally stationary component is such that rotation is inhibited from occurring about the top drive 345 (and the axis of the tubular running tool 341 in the depicted embodiment) between the first member 303 and the rotationally stationary component. Furthermore, those having ordinary skill in the art will appreciate that the first member of the rotation inhibiting apparatus may connect to any relatively rotationally stationary component of the drilling rig, and not only the top drive as shown in FIGS. 3A-3C, without departing from the scope of the present disclosure. For example, in other embodiments, the first member of the rotation inhibiting apparatus may connect to another non-rotating portion of the top drive, such as the motor housing, may connect to a non-rotating portion of a tubular running tool (if present), and/or may connect to any component disposed with the drilling rig that remains rotationally stationary with respect to the drilling rig.

Additionally, the second end 313 of the second member 309 may connect to the tubular handling apparatus 351. For example, as shown, the second end 313 of the second member 309 may connect, such as pivotally connect (if desired), to the plate 353 of the tubular handling apparatus 351 (though the second member 309 may connect to any component to be restricted from rotation, e.g., tubular handling apparatus 351, in accordance with embodiments disclosed herein). However, as with the connection of the first member 303, the depicted connection between the second member 309 and the tubular handling apparatus 351 is such that rotation occurring about the axis of the tubular running tool 341 and/or the top drive 345 is inhibited between the second member 309 and the tubular handling apparatus 351. This arrangement of the rotation inhibiting apparatus 301 may enable the first member 303 and the second member 309 of the rotation inhibiting apparatus 301 to be connected to each other such that the first member 303 and the second member 309 may move with respect to each other along the axis of the tubular running tool 341. Further, this arrangement of the rotation inhibiting apparatus 301 may enable the non-rotating component (e.g., bail ears 347) of the top drive 345 connected to the first member 303 and the tubular handling mechanism 351 connected to the second member 309 to move with respect to each other along the rotational axis of the top drive 345 path while remaining connected to the rotation inhibiting apparatus 301.

As shown, one or both of the first member 303 and the second member 309 may include a bracket assembly, in which the bracket assemblies are connected to each other. For example, as shown in FIGS. 3A-3C, the first member 303 may include one or more arms, in which the arms, if multiple, may be disposed substantially parallel with each other. The arms of the bracket assembly may further include a brace disposed therebetween to provide support to the arms of the bracket assembly. Those, however, having ordinary skill in the art will appreciate that the present disclosure is not so limited to the use of a bracket assembly for the members of the rotation inhibiting apparatus, as other structures and arrangements may be used for one or more members of the rotation inhibiting apparatus (other examples discussed more below).

Referring still to FIGS. 3A-3C, the rotation inhibiting apparatus 301 may be connected to the tubular handling mechanism 351 such that the first member 303 and the second member 309 may remain rotationally stationary with respect to each other about the rotational axis of the tubular running tool 341 and the top drive 345. As such, this arrangement may enable the first member 303 and the second member 309 to inhibit rotation between each other, e.g., rotation occurring about the rotational axis of the tubular running tool 341 and the top drive 345. For example, rotational movement may be received by the tubular handling mechanism 351 from the top drive 345. Particularly, as a portion of the tubular handling mechanism 351 may be supported from the quill of the top drive 345 for vertical movement therewith, in which the tubular handling mechanism 351 also includes another portion allowing independent rotation relative to the rotatable quill (e.g., rotationally stationary relative to the top drive), rotational movement of the another portion of the tubular handling mechanism may be restricted via the rotation inhibiting apparatus.

For example, if tubular running tool 341 is rotating a tubular member while making-up and/or breaking-out a threaded connection between the tubular member and a string of tubular members, the tubular handling mechanism 351 may receive, for example, torque to impart rotational movement from the mandrel 349 of the tubular running tool 341 rotated by the top drive 345.

The second member 309 connected to the tubular handling mechanism 351 may receive, at least partially, torque to impart rotational movement to the tubular handling mechanism 351. Because the first member 303 and the second member 309 of the rotation inhibiting apparatus 301 are retained rotationally stationary with respect to the rotational axis of the top drive 345, the second member 309 may inhibit the first member 303 from rotating. Further, as the first member 303 is connected to the rotationally stationary portion of the tubular running apparatus 341, the first member 303 may transfer the rotational movement to this rotationally stationary component. Thus, rotational movement received by the tubular handling mechanism 351 may be inhibited, at least partially, by the rotationally stationary component of the tubular running tool 341 using the rotation inhibiting apparatus 301. As such, this may prevent rotational movement between the tubular handling mechanism 351 and the rotationally stationary component as rotational movement is inhibited using the rotation inhibiting apparatus 301. Further, because the first member 303 and the second member 309 of the rotation inhibiting apparatus 301 may move with respect to each other along the rotational axis of the tubular running tool 341, the rotation inhibiting apparatus 301 enables a tubular running tool, such as the tubular running tool 341 connected to the top drive 345 of the tubular running tool 341, to move with respect to the tubular handling mechanism 351 along the rotational axis of the tubular running tool 341 and the top drive 345.

With reference specifically to FIG. 3A, the rotation inhibiting apparatus 301 may be disposed on a side of the tubular running tool 341, e.g., that closest to an access opening of the drilling rig. This may be noted as the rotation inhibiting apparatus 301 is connected to the plate 353 on the same side as the tubular handling mechanism 351. However, those having ordinary skill in the art will appreciate that the present disclosure is not limited to only this arrangement, as a rotation inhibiting apparatus in accordance with embodiments of the present disclosure may be disposed on any side of the top drive and/or the tubular running tool, e.g., where there is suitable clearance.

Further, with reference to FIG. 3A, the rotation inhibiting apparatus 301 may be disposed out-of-line with respect to a centerline of the tubular running tool 341. For example, the rotation inhibiting apparatus 301 may not cross a centerline of the tubular running tool 341, such as cross along a rotational axis of the top drive 345. However, those having ordinary skill in the art will appreciate that the present disclosure is not so limited. For example, as shown in FIGS. 3B and 3C, the rotation inhibiting apparatus 301 may be arranged such that the rotation inhibiting apparatus 301 is disposed across the centerline of the tubular running tool 341, such as by having the rotation inhibiting apparatus disposed about portions of the tubular running tool 341 (e.g., quill 343 and/or mandrel 349). Furthermore, as shown with reference to FIGS. 3A-3C, both the first member 303 and the second member 309 of the rotation inhibiting apparatus 301 may be disposed on the same and/or opposite sides of the tubular running tool 341 and top drive 345. For example, in FIGS. 3A-3C, the first member 303 and the second member 309 are each disposed on the same side of the tubular running tool 341 and the top drive 345. However, in another embodiment, the first member 303 may be connected to one side of the top drive 345, such as the side of the top drive 345 closest to the access opening of the drilling rig, and the second member 309 may be connected to the other side of the tubular running tool 341, such as the side of the tubular running tool 341 furthest from the access opening of the drilling rig. As such, those having ordinary skill in the art will appreciate that other structures and arrangements may be used for the rotation inhibiting apparatus without departing from the scope of the present disclosure.

Figure 4:
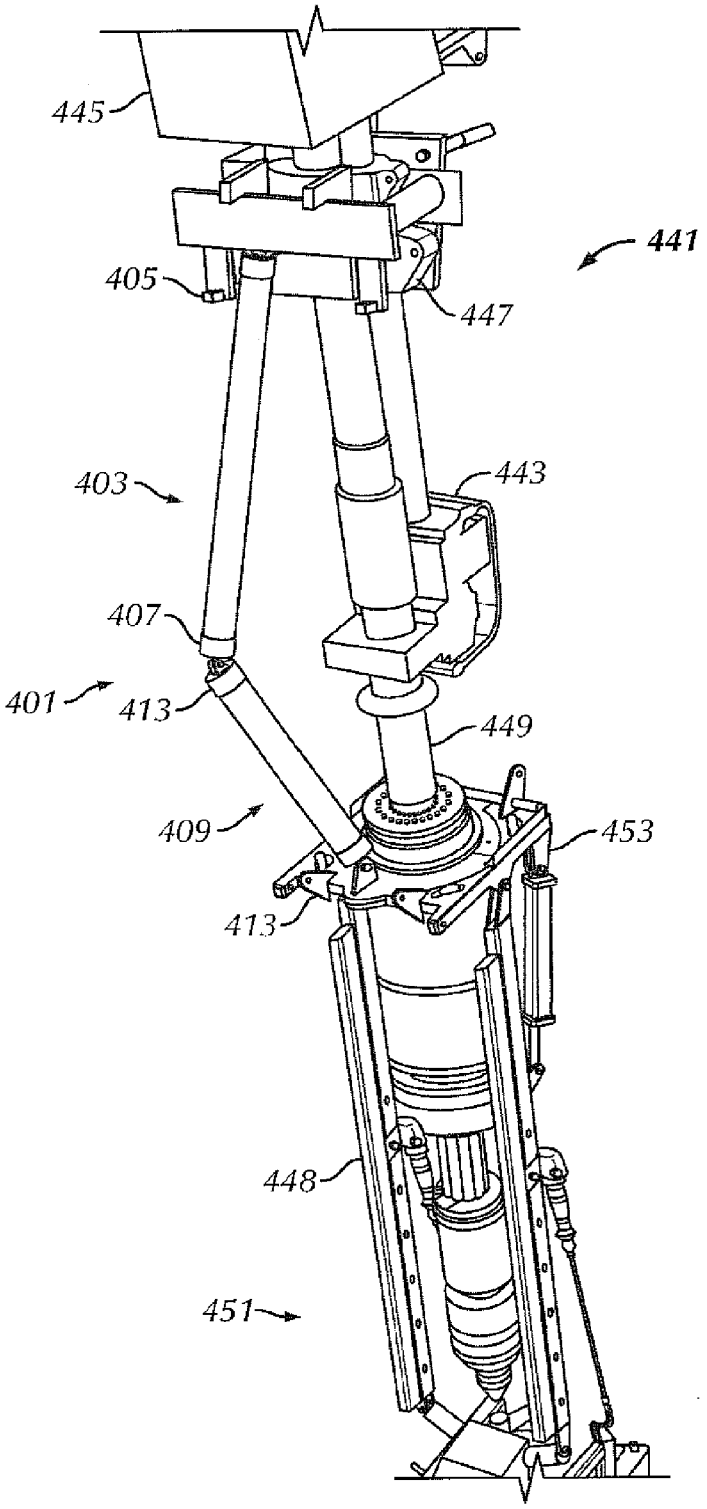
FIG. 4 shows a perspective view of a rotation inhibiting apparatus connected to a tubular handling mechanism in accordance with embodiments disclosed herein.

Referring now to FIG. 4, a perspective view of a rotation inhibiting apparatus 401 connected to a tubular handling mechanism 451 in accordance with embodiments disclosed herein is shown. Similar to the embodiments shown in FIGS. 3A-3C, a tubular running tool 441 may include a mandrel 449 operatively connected to a top drive 445 having a quill 443, in which the top drive 445 may be used to rotate the mandrel 449. The rotation inhibiting apparatus 401 may include a first member 403 and a second member 409 connected to each other, in which the first member 403 may be connected to a rotationally stationary component of the top drive 445 (e.g., bail ears 447 of the top drive 445 in this embodiment) and the second member 409 may be connected to the tubular handling mechanism 451.

Further, with reference to FIG. 4, the first member 403 may connect to the second member 409 such that that first member 403 and the second member 409 may move with respect to each other along an axis of the tubular running tool 441 and/or the top drive 445. Particularly, in this embodiment, the second end 407 of the first member 403 may connect to the first end 411 of the second member 409 using a pivot, as shown, as discussed above, or any other similar connection known in the art, thereby enabling the movement between the first member 403 and the second member 409 with respect to each other. Furthermore, the first member 403 and the second member 409 may connect to each other and the tubular running tool 441 such that the first member 403 and the second member 409 remain rotationally stationary with respect to the rotational axis of the tubular running tool 441 and the top drive 445. In accordance with one or more embodiments disclosed herein, the connection between the first member and the second member, in addition to the connections between the first member and a component of the drilling rig and the second member and a component of the drilling rig, may include a pivot, a U-joint, and/or any other connection known in the art. However, in one embodiment, at least one of the connections between the first member and the second member, between the first member and a component of the drilling rig, and between the second member and a component of the drilling rig is a pivot (i.e., a connection that may rotate about only one axis). One or more of the remaining connections may be a pivot, a U-joint (i.e., a connection that may rotate about two or more axes), or any other connection known in the art.

Additionally, in this embodiment, rather than having a bracket assembly as shown in FIGS. 3A-3C, one or both of the first member 403 and the second member 409 may include a tube. The tubes of the first member 403 and the second member 409 may be connected to each other, such as through using a pivot. However, as discussed above, other structures and arrangements may be used for one or more members of the rotation inhibiting apparatus without departing from the scope of the present disclosure. For example, as discussed more below, a rectangular member may be used for one or both of the first member and the second member. As such, in accordance with embodiments disclosed herein, a tubular member having substantially any cross-sectional shape or size, thereby encompassing both a tube and a rectangular member, may be used for the first member and/or the second member of the rotation inhibiting apparatus. Further, the members of the rotation inhibiting apparatus may be substantially hollow or have voids formed therein, e.g., to decrease the weight of the rotation inhibiting apparatus and/or to enable having the members of the rotation inhibiting apparatus slidingly engage each other. However, those having ordinary skill in the art will appreciate that the present disclosure is not so limited, as one or more members of the rotation inhibiting apparatus may be solid, e.g., for increased strength.

Figure 5A:
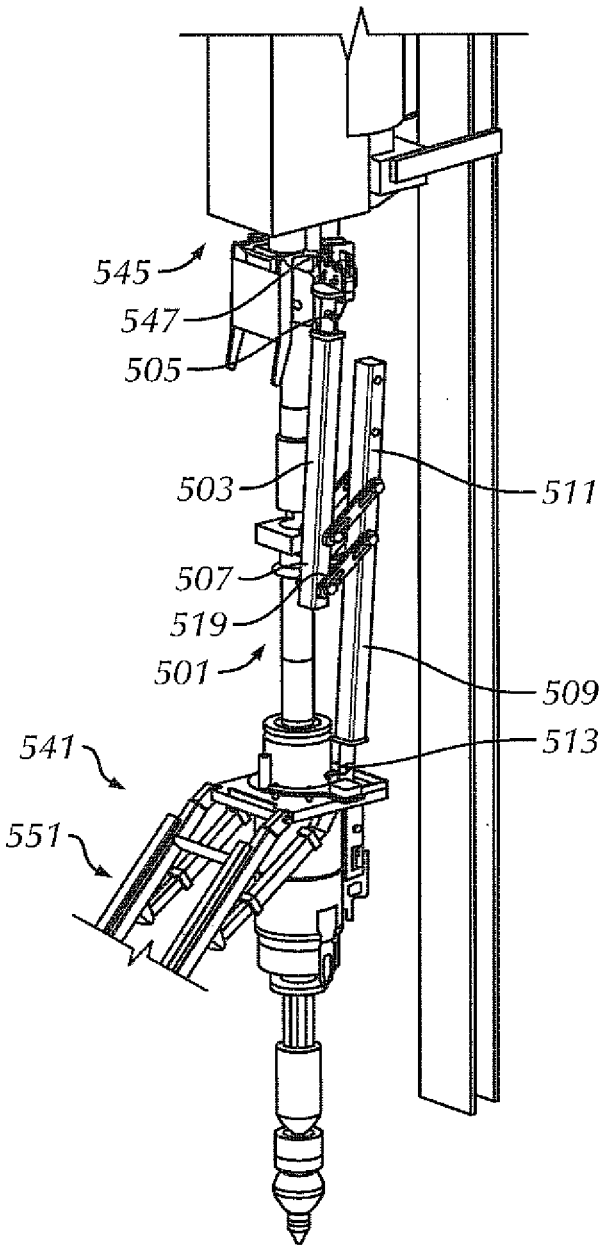
FIGS. 5A-5D show multiple views of a rotation inhibiting apparatus in accordance with embodiments disclosed herein.
Figure 5B:
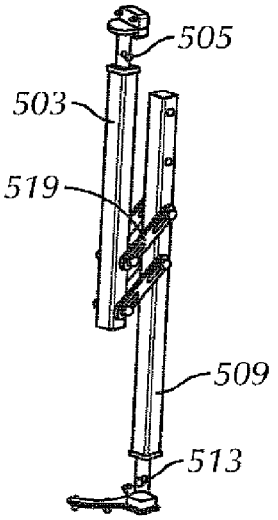

Referring now to FIGS. 5A-5D, multiple perspective views of a rotation inhibiting apparatus 501 are shown. The rotation inhibiting apparatus 501 may include a first member 503 and a second member 509 connected to each other. Further, as with the above embodiments, the rotation inhibiting apparatus 501 may be connected between a tubular handling mechanism 551 and a top drive 545 (e.g., as shown in FIG. 5A). As such, the first member 503 may connect to a rotationally stationary component of the drilling rig (e.g., a bail ear 547 of the top drive 545), and the second member 509 may connect to a component to be rotationally stationary (e.g., the tubular handling mechanism 551 and/or the outer housing of the tubular running tool 541). As shown in FIGS. 5A-5D, the first member 503 and the second member 509 may connect to the rotationally stationary component and the tubular running tool using one or more connections, such as by using one or more U-joints, as shown, and/or other types of connections, such as one or more pivots. Further, the rotation inhibiting apparatus 501 may include a support structure 517, in which the support structure 517 may secure to a component of the top drive 545, such as a bail ear 547 of the top drive 545, as shown, and/or a traveling block (e.g., traveling block 103 shown in FIG. 1A).

As with the above embodiments, the first member 503 may connect to the second member 509 such that the first member 503 and the second member 509 may move with respect to each along an axis of a tubular running tool. Particularly, in this embodiment, the second end 507 of the first member 503 may connect to the first end 511 of the second member 509 using one or more linkages 519, thereby enabling the movement between the first member 503 and the second member 509 with respect to each other. In one or more embodiments though, two or more linkages are shown to connect the first member and the second member of the rotation inhibiting apparatus together. Thus, those having ordinary skill in the art will appreciate that at least two linkages may be used to connect the first member and the second member of the rotation inhibiting apparatus in accordance with one or more embodiments of the present disclosure. As shown, the linkages 519 may be removably connected to one and/or both of the first member 503 and the second member 509, such as by using pins to removably connect the linkages 519 to one and/or both of the first member 503 and the second member 509. For example, as shown specifically in FIGS. 5A-5D, the linkages 519 may be removably connected to the second member 509, thereby enabling the linkages 519 to have incremental adjustments, as desired, between the first member 503 and the second member 509.

Furthermore, the first member 503 and the second member 509 may be connected such that the first member 503 and the second member 509 remain rotationally stationary with respect to each other about a rotational axis, such as the rotational axis of the top drive 545. Furthermore still, in this embodiment, rather than having a bracket assembly or a tube, as shown in FIGS. 3A-3C and 4, respectively, one or both of the first member 503 and the second member 509 may include a rectangular member. The rectangular members of the first member 503 and the second member 509 may be connected to each other, such as through using at least one linkage 519.

Figure 5C:
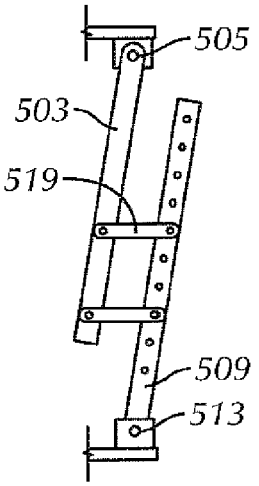
Figure 5D:
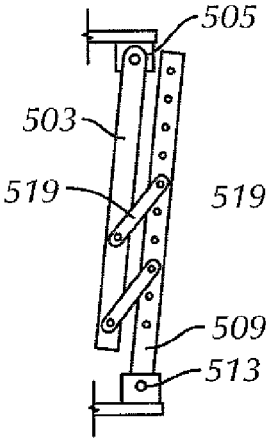

As shown with reference to FIG. 5C, the first member 503 and the second member 509 of the rotation inhibiting apparatus 501 may be arranged such that the first end 505 of the first member 503 is not in vertical alignment with the second end 513 of the second member 509. However, as the first member 503 and the second member 509 move with respect to each other, the first end 505 of the first member 503 may move into substantially vertical alignment with the second end 513 of the second member 509, as shown in FIG. 5D. Further, the at least one linkage 519 (shown as dual linkages 519) connecting the first member 503 to the second member 509 may be adjusted, as desired, to have the first end 505 of the first member 503 in substantial vertical alignment with the second end 513 of the second member 509. However, those having ordinary skill in the art will appreciate that the present application is not so limited, as the members of the rotation inhibiting apparatus may be, or may not be, in vertical alignment with each other, as desired. As such, the rotation inhibiting apparatus 501 may be used to inhibit rotation between multiple components within a drilling rig, such as between the tubular handling mechanism 551 and a rotationally stationary portion of the top drive 545 (or other rotationally stationary component disposed upon the drilling rig).

Figure 6A:
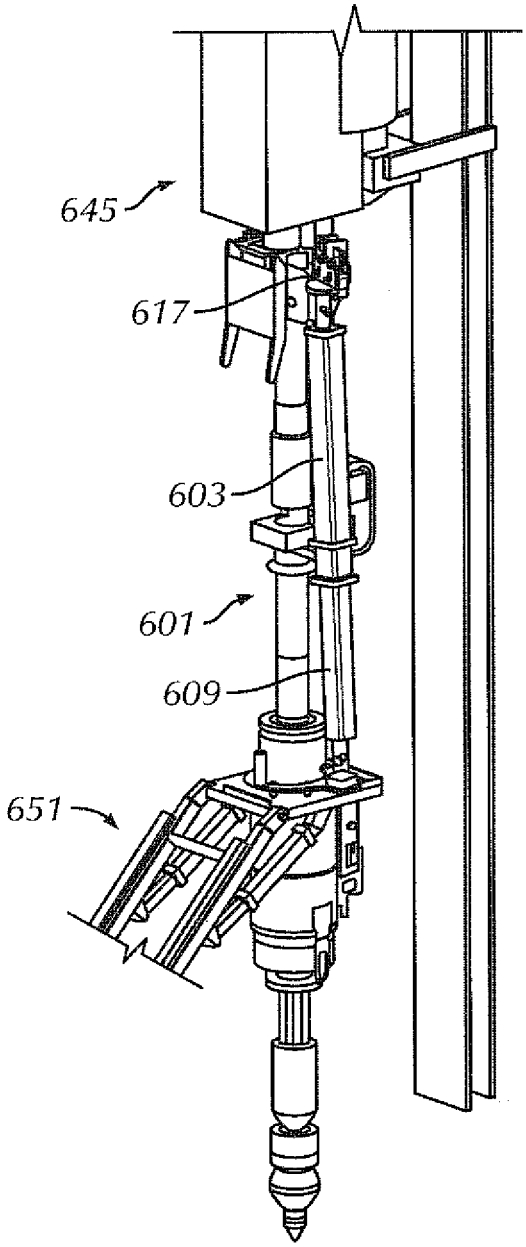
FIGS. 6A-6C show multiple views of a rotation inhibiting apparatus in accordance with embodiments disclosed herein.
Figure 6B:
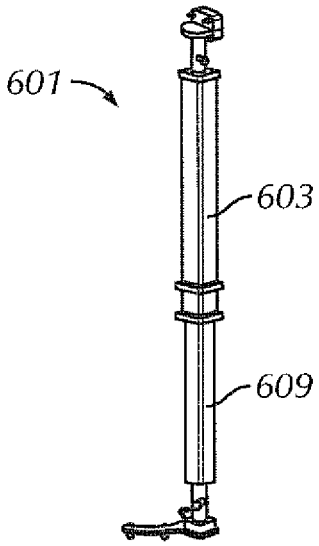
Figure 6C:
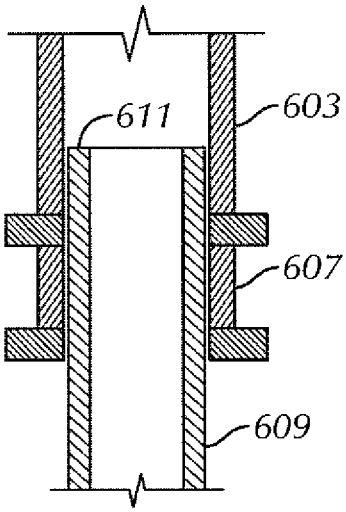

Referring now to FIGS. 6A-6C, multiple views of a rotation inhibiting apparatus 601 are shown. Specifically, FIG. 6A shows a perspective view of the rotation inhibiting apparatus connected between a tubular handling mechanism 651 and a top drive 645, FIG. 6B shows a perspective view of the rotation inhibiting apparatus 601, and FIG. 6C shows a partial cross-sectional view of the rotation inhibiting apparatus 601. As with the above embodiments, the rotation inhibiting apparatus 601 may be connected to the tubular handling mechanism 651 and may include a first member 603 and a second member 609 connected to each other. The first member 603 may connect to a rotationally stationary component (e.g., the top drive 645), and the second member 609 may connect to a component to be held stationary (e.g., a tubular handling mechanism 651). Similar to the embodiment shown in FIGS. 5A-5C, the first member 603 and the second member 609 may be connected using one or more connections, such as U-joints, and the rotation inhibiting apparatus 601 may include a support structure 617, in which the support structure 617 may secure to a bail ear 647 of the top drive 645. Further, the first member 603 and the second member 609 may connect to each other and between one or more components of a tubular running tool such that the first member 603 and the second member 609 may remain rotationally stationary with respect to a rotational axis, such as remain rotationally stationary with respect to the rotational axis of the top drive 645.

The first member 603 may additionally connect to the second member 609 such that the first member 603 and the second member 609 may move with respect to each along the rotational axis of a tubular running tool. Particularly, in this embodiment, the first member 603 may include a female member, and the second member 609 may include a male member. As such, the second member 609 may be disposed, at least partially, within the first member 603. Specifically, the first end 611 of the second member 609 may be disposed, at least partially, within the second end 607 of the first member 603. This may enable the first member 603 to slidingly engage the second member 609 such that the first member 603 may move with respect to the second member 609, e.g., along a rotational axis of top drive 645. As such, the first member 603 and the second member 609 may be sized such that a close-fit is formed between the first member 603 and the second member 609, if desired. With a close-fit, the first member 603 and the second member 609 may still slidingly engage each other, but this may enable close interaction and/or, at least some friction between the first member 603 and the second member 609, as desired. Further, the female member may be fanned with one or more flanges if desired, such as a flange disposed at the second end 607 of the first member 603, to facilitate a close-fit between the first member 603 and the second member 609. Furthermore, the flanges may have a material disposed thereon, or the flanges may be formed of a different material than the remainder of the first member 603 and the second member 609, such that the flanges reduce frictional forces for contacting the first member 603 and the second member 609.

Those having ordinary skill in the art will appreciate that, though the rotation inhibiting apparatus is shown with the first member as a female member and the second member as a male member, the present disclosure is not so limited, as the present disclosure contemplates having other structures and arrangements for a rotation inhibiting apparatus in accordance with embodiments disclosed herein. For example, in another embodiment, the first member may include a male member and the second member may include a female member. Further, in yet another embodiment, the first member and the second member may both be male members, with a female member disposed therebetween to enable movement between the first member and the second member.

Figure 7A:
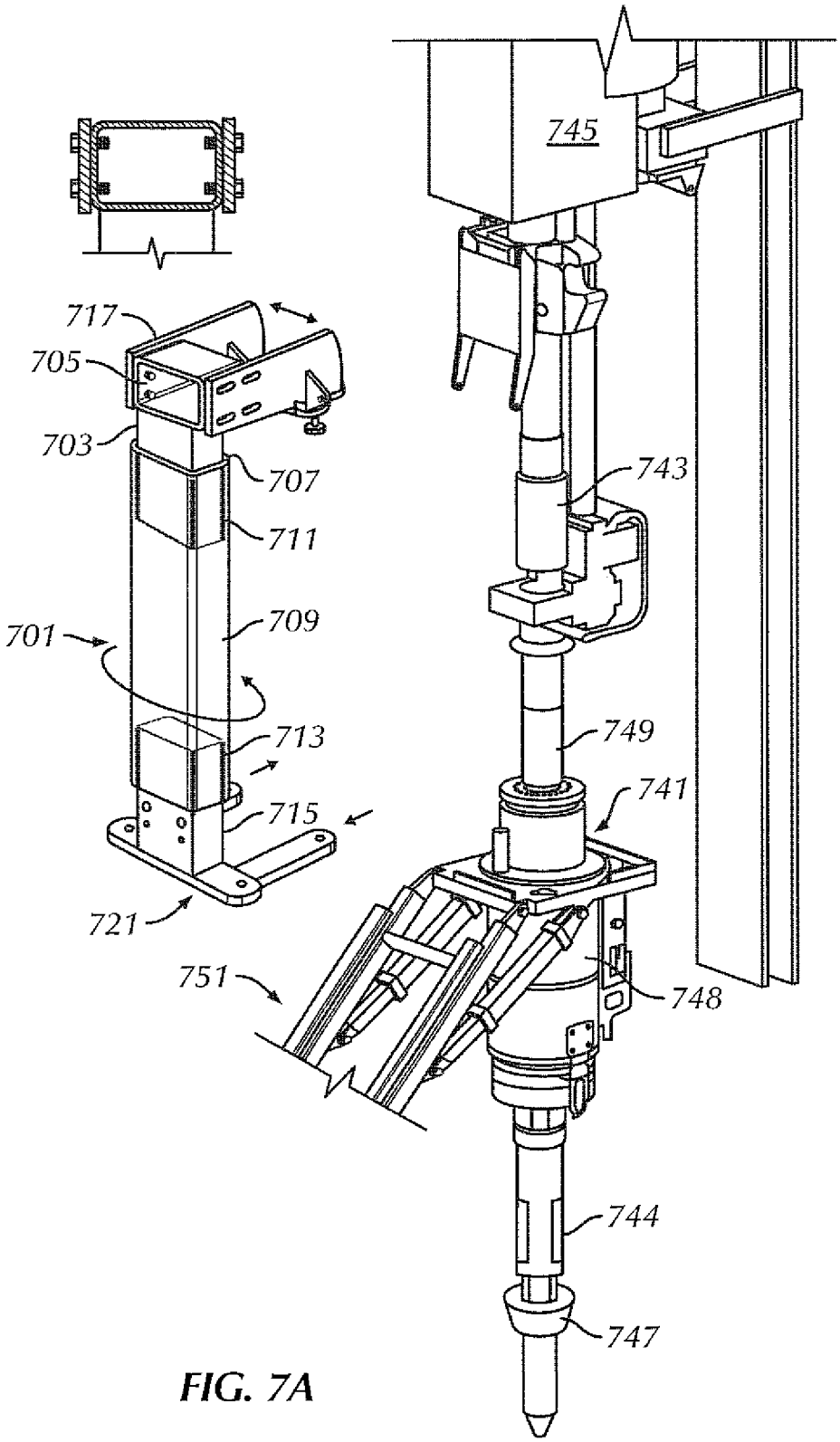
FIGS. 7A-7D show multiple views of a rotation inhibiting apparatus in accordance with embodiments disclosed herein.
Figure 7B:
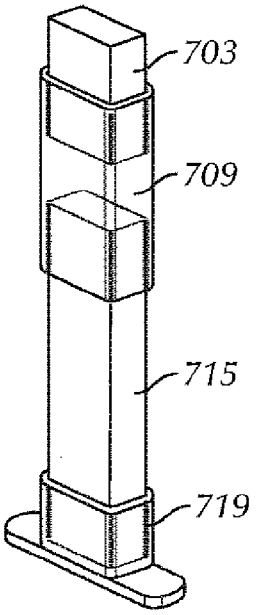
Figure 7C:
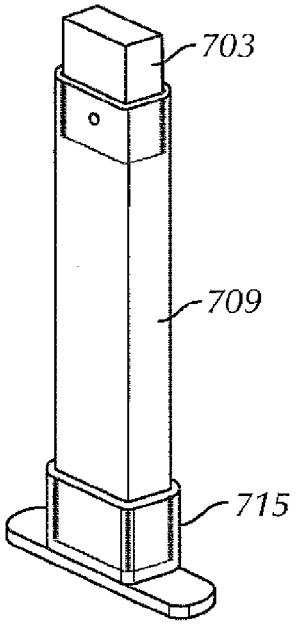
Figure 7D:
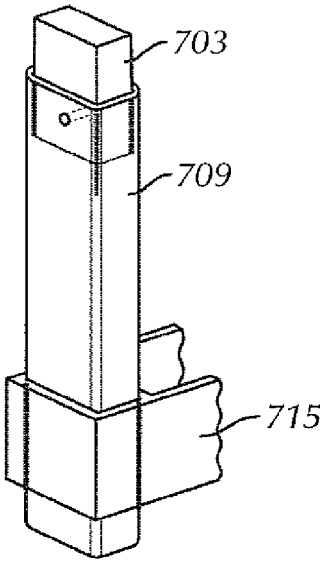

Referring now to FIGS. 7A-7D, multiple perspective views of a rotation inhibiting apparatus 701 in accordance with embodiments disclosed herein are shown. Specifically, FIG. 7A shows a rotation inhibiting apparatus 701 connected to a tubular handling mechanism 751, and FIGS. 7B-7D show alternative embodiments for the rotation inhibiting apparatus 701.

With reference to FIG. 7A, a tubular running tool 741 may include a mandrel 749 operatively connected to a top drive 745 having a quill 743, in which the top drive 745 may be used to rotate the mandrel 749 using the quill 743. Further, the tubular running tool 741 may include one or more gripping members 744 selectively deployable to engage a tubular member and a seal 747 to seal with an inner surface of a tubular member. Furthermore, in addition to a first member 703 and a second member 709, the rotation inhibiting apparatus 701 includes a third member 715. In this embodiment, the first member 703 may be connected to a rotationally stationary component of a drilling rig (e.g., a non-rotating portion of the top drive 745), the third member 715 may be connected to the tubular handling mechanism 751, and the second member 709 may be connected between the first member 703 and the third member 715. As such, the second member 709 may be connected to the tubular handling mechanism 751 through the third member 715. As such, in accordance with one or more embodiments disclosed herein, the third member 715 may be connected to the tubular handling mechanism 751 using a second support structure 721. As shown, the second support structure 721 may include two or more arms that extend therefrom and connected to the tubular handling mechanism 751 (or other component of the drilling rig desired to remain rotationally stationary with respect to the rotational inhibiting apparatus 701). The two or more arms of the second support structure 721 may be arranged such that the arms have substantially equal and opposite forces applied thereto from the third member 715 and/or the tubular handling mechanism 751, such as by having the arms of the second support structure 721 substantially one or more of the same dimensions (e.g., lengths, heights, and/or the same widths).

Similar to the embodiments shown above, the first member 703, the second member 709, and the third member 715 may be used to slidingly engage each other such that the members 703, 709, and 715 may move with respect to each other, e.g., along a rotational axis of top drive rotation. Furthermore, as shown in this embodiment, the rotation inhibiting apparatus 701 may include a support structure 717, such as connected to the first member 703, in which the support structure 717 may connect to one or more components of the top drive 745 (if included) of the tubular running tool 741.

Those having ordinary skill in the art will appreciate that, though the rotation inhibiting apparatus is shown with two members is some embodiments and three members in other embodiments, the present disclosure is not so limited, as the present disclosure contemplates having other structures and arrangements for a rotation inhibiting apparatus in accordance with embodiments disclosed herein. For example, in another embodiment, such as shown in FIG. 7B, the rotation inhibiting apparatus may include four members: a first member 703, a second member 709, a third member 715, and a fourth member 719. One or more of the members may be used to slidingly engage each other (e.g., telescoping members) to have the members move with respect to each other. As such, a rotation inhibiting apparatus in accordance with embodiments disclosed herein is not limited to only structures and arrangements having only two members. Further, as shown in FIGS. 7C and 7D, some of the members of the rotation inhibiting apparatus may be connected to each other to enable movement therebetween, while other members of the rotation inhibiting apparatus may be rigidly connected to each other. For example, in FIGS. 7C and 7D, the first member 703 and the second member 709 are rigidly connected to each other, such as with a bolt, while the second member 709 and the third member 715 are connected to each other (e.g., slidingly engaged) to enable movement therebetween.

Figure 8A:
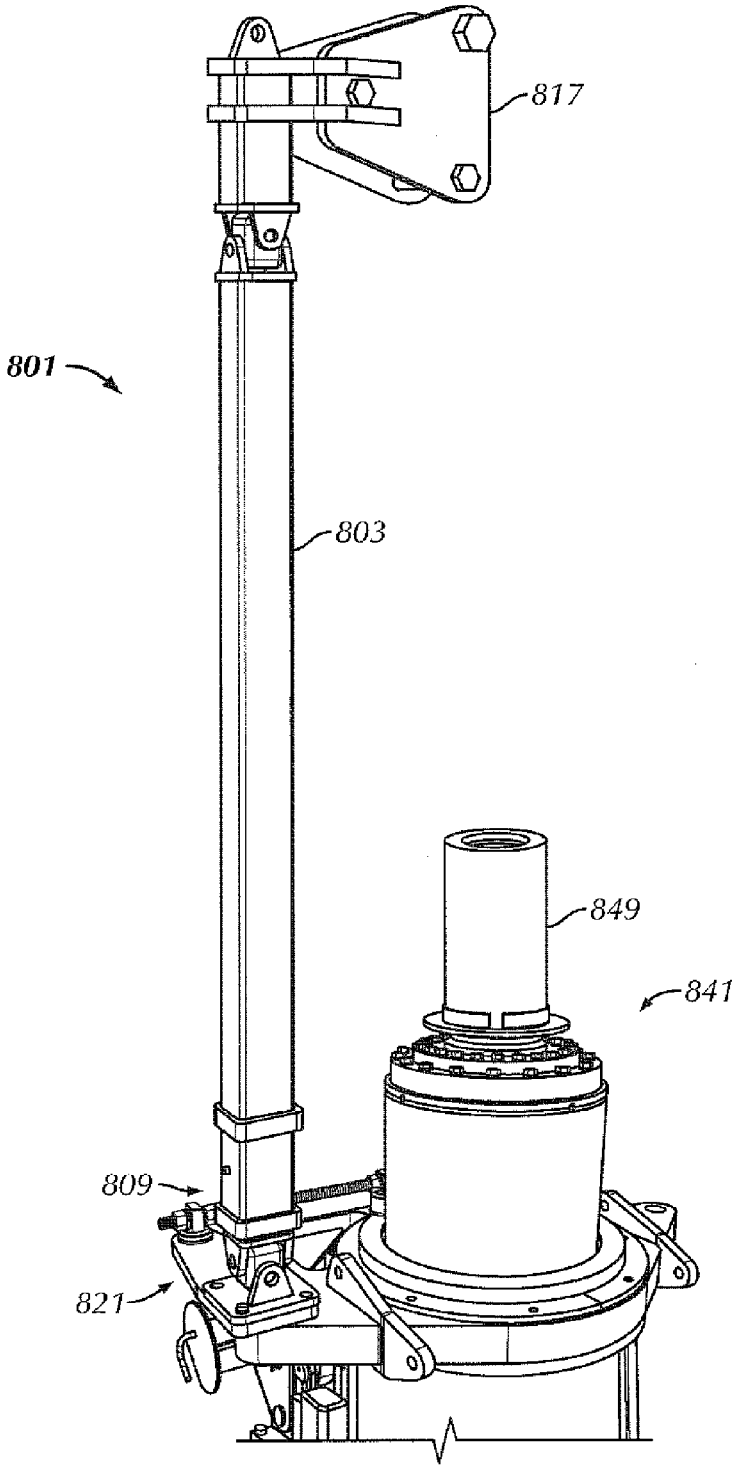
FIGS. 8A-8E show multiple views of a rotation inhibiting apparatus in accordance with embodiments disclosed herein.
Figure 8B:
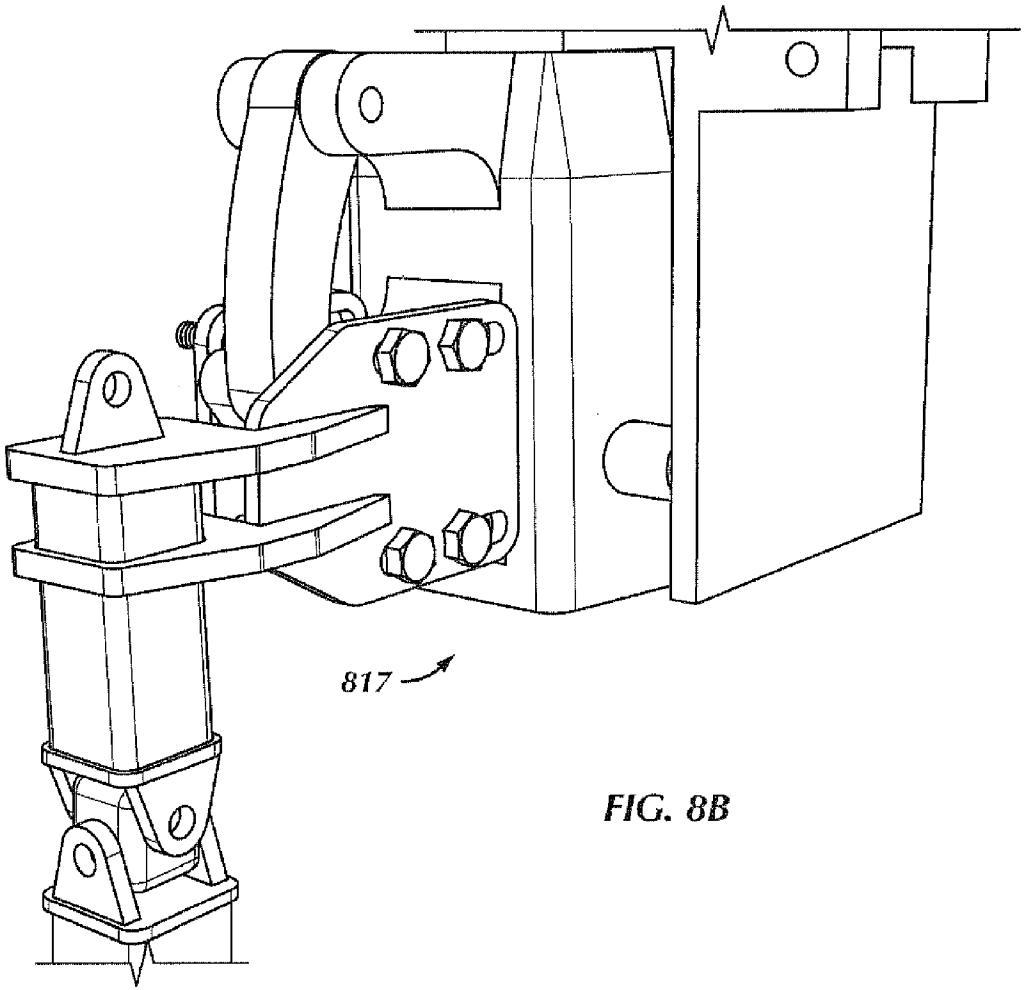
Figure 8C:
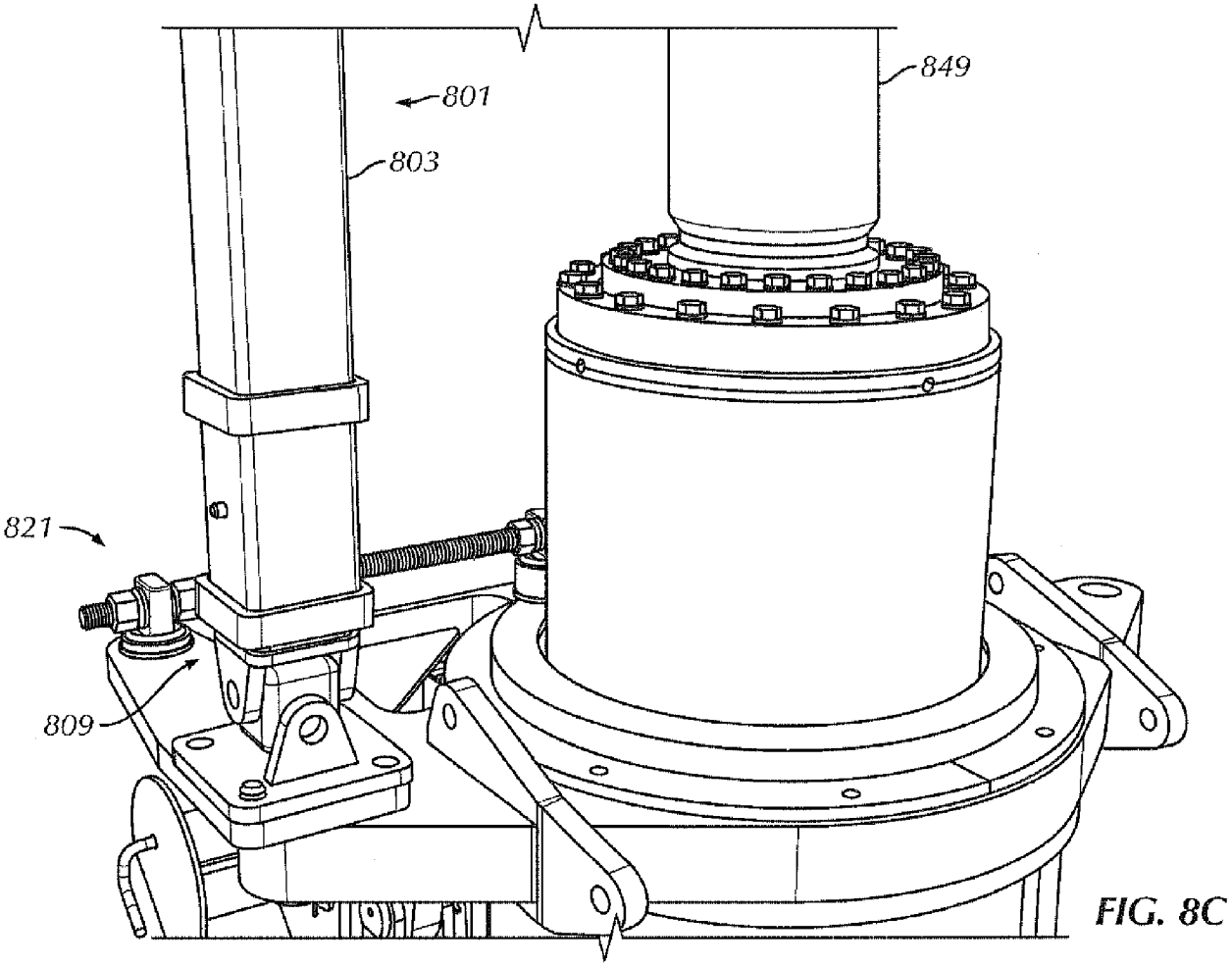
Figure 8D:
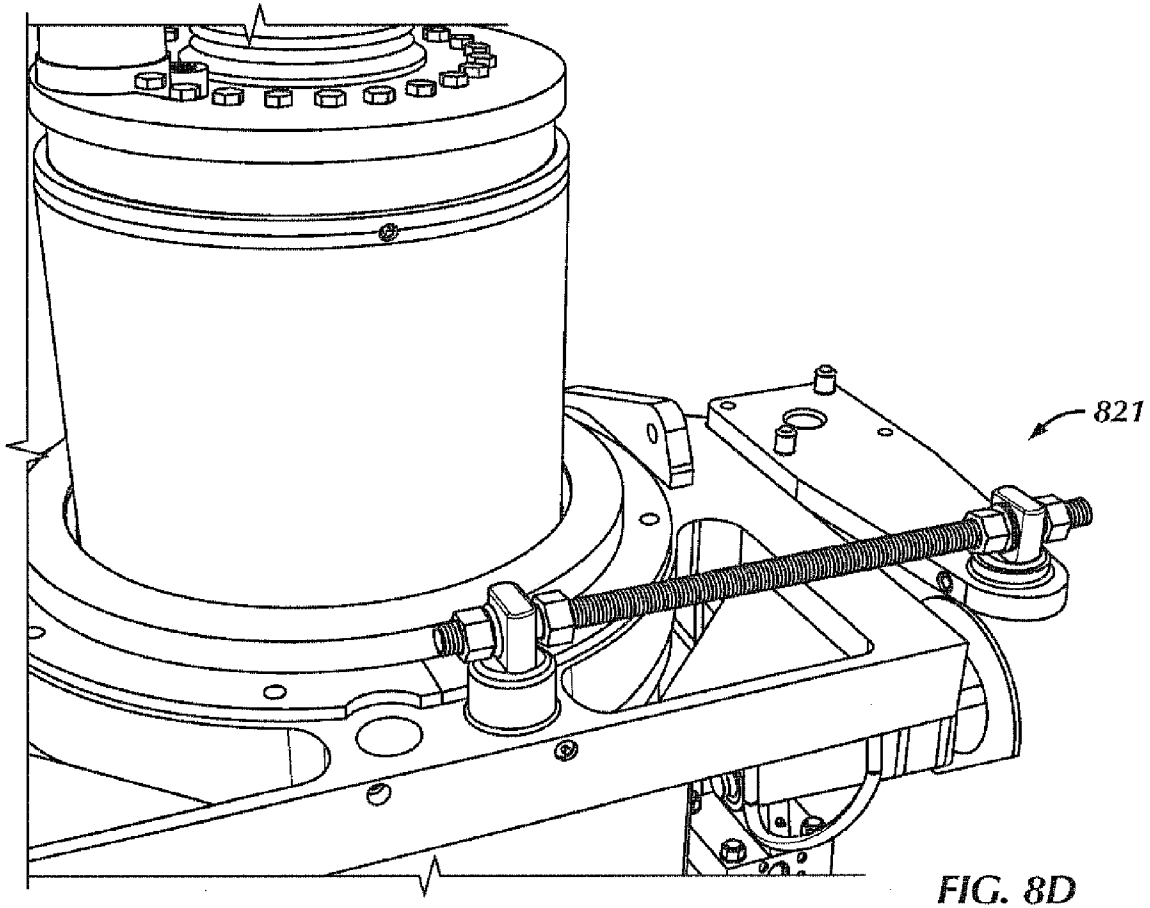

Referring now to FIGS. 8A-8D, multiple perspective views of a rotation inhibiting apparatus 801 in accordance with embodiments disclosed herein are shown. Specifically, FIG. 8A shows a rotation inhibiting apparatus 801, FIG. 8B shows a detailed view of a first support structure 817 of the rotation inhibiting apparatus 801, and FIGS. 8C and 8D show detailed views of a second support structure 821 of the rotation inhibiting apparatus 801.

With reference to FIG. 8A, a tubular running tool 841 may include a mandrel 849, in which a top drive may include a quill that connects to the mandrel 849. Further, as similar to the above embodiments, the rotation inhibiting apparatus 801 includes a first member 803 and a second member 809 connected to each other. Particularly, in this embodiment, the first member 803 may include a female member and the second member 809 may include a male member, in which the male member may slidingly engage the female member. For example, the second member 809 may slidingly engage, such as having a telescoping movement, with the first member 803. As such, the first member 803 and the second member 809 may move with respect to each other along a rotational axis of the tubular running tool 841.

Furthermore, as shown, the rotation inhibiting apparatus 801 may include the first support structure 817 and the second support structure 821. As such, in this embodiment, the first support structure 817 may be used to connect the first member 803 to a rotationally stationary component of the drilling rig (e.g., a rotationally stationary, relative to the drilling rig, component of a top drive), and the second support structure 821 may be used to connect the second member 809 a component to be held rotationally stationary (e.g., a tubular handling mechanism).

In this embodiment, the second support structure 821 may include a rotation adjustment system, in which the rotation adjustment system may be used adjust the rotation of the rotation inhibiting apparatus 801 connected thereto. The rotation adjustment system may be used to adjust the orientation of the second member 809 connected to the second support structure 821 and the rotation adjustment system, such as by enabling the rotation adjustment system to rotate the second member 809 about an axis of rotation of the connection between the second member 809 and the second support structure 821. For example, in one or more embodiments, the tubular handling mechanism may not be aligned adjacent to an access opening (e.g., v-door) of a drilling rig, and may thereby inhibit the functionality of the tubular handling mechanism from being able to grasp a tubular member within and through the access opening of the drilling rig. However, the rotation adjustment system may be used to adjust the orientation between two or more components within the drilling rig (e.g., between a bail ear of a top drive and a tubular handling mechanism), as one of the components of the drilling rig may be connected to the rotation adjustment system and may be rotated with respect to the drilling rig, and thereby rotated with respect to the rotation inhibiting apparatus, accordingly. As such, the rotation adjustment system may be used to adjust the orientation of one or more components within a drilling rig, such as adjust the orientation of the tubular handling mechanism within the drilling rig, as desired.

Figure 8E:
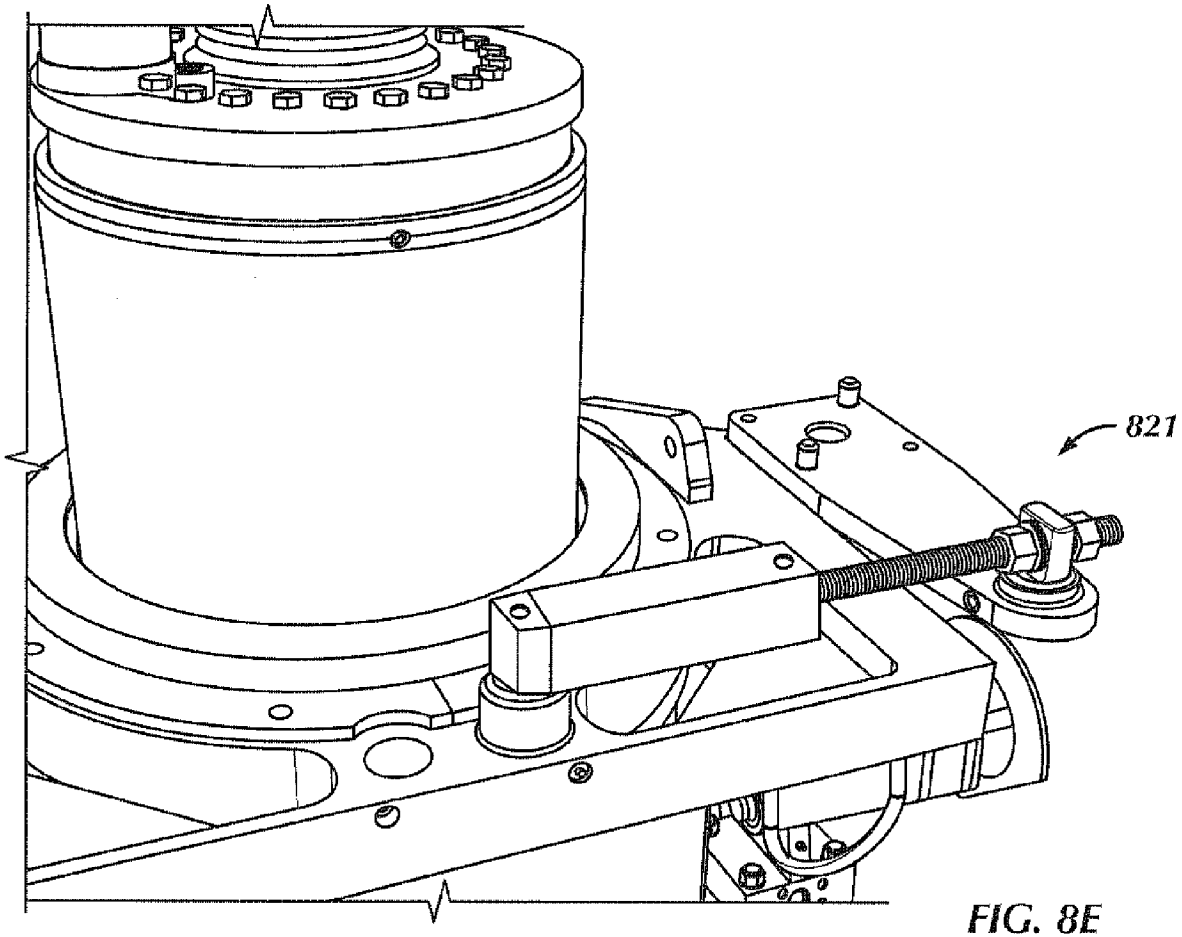

For example, if desired to rotate the second member 809 with respect to the second support structure 821, such as to have a desired orientation of the second member 809, and thereby a desired orientation for the rotation inhibiting apparatus 801, the rotation adjustment system may be adjusted to have the second member 809 rotate about an axis of rotation of the connection between the second member 809 and the second support structure 821. Specifically, as shown in the embodiments in FIGS. 8A-8D, the rotation adjustment system may include an adjustment member with a securing mechanism connected thereto. The adjustment member may include, for example, a threaded rod, as shown in FIGS. 8A-8D, or any other adjustment member known in the art, such as a slide or slot member, and the securing mechanism may include, for example, a threaded nut, as shown in FIGS. 8A-8D, or any other securing mechanism known in the art, such as a bolt, screw, or hinge. In such an embodiment, the adjustment member of the rotation adjustment system may be connected to the second member 809 of the rotation inhibiting apparatus 801 such that the second member 809 may rotate with respect to the second support structure 821, and the securing mechanism may be used to secure the second member 809 in a desired position with respect to the adjustment member. As such, this may enable the second member 809, and thereby the rotation inhibiting apparatus 801 to be oriented in a desired direction, such as ensuring that the rotation inhibiting apparatus 801 is directed in a direction towards, for example, an access opening of the drilling rig. Further, as shown in FIG. 8E, the rotation adjustment system may additionally and/or alternatively include an actuator, in which the actuator is coupled within the rotation adjustment system to rotate the second member of the rotation inhibiting apparatus with respect to the drilling rig (e.g., one or more components of the second support structure). In such an embodiment, the actuator may be powered hydraulically, pneumatically, and/or electrically to enable the rotation within the rotation adjustment system.

Those having ordinary skill in the art will appreciate that other structures and arrangements may be used for the support structures in accordance with embodiments disclosed herein. For example, a rotation adjustment system in accordance with embodiments disclosed herein may include a slotted member for the adjustment member, in which the second member connected to the rotation adjustment system may enable adjustment of the orientation of the second member with respect to the second support structure. Further, a rotation adjustment system, though only shown within FIGS. 8A-8D, may also be included within one or more other embodiments disclosed herein without departing from the present disclosure. For example, the rotation adjustment system may be included at either and/or both ends of a rotation inhibiting apparatus, such as alternatively and/or additionally having a rotation adjustment system disposed at a top end of a rotation inhibiting apparatus. Thus, those having ordinary skill in the art will appreciate that the present disclosure contemplates other structures and arrangements for one or more support structures in accordance with embodiments disclosed herein.

As discussed above, a rotation inhibiting apparatus may include one or more female members. As such, the inner profile of the female member (and, accordingly, the outer profile of the corresponding male member) may have multiple forms and shapes in accordance with embodiments disclosed herein, e.g., ovate or polygonal or circular with a key therebetween. For example, the inner profiles of the female members may include a rectangular profile, a hexagonal profile, and/or a star-shaped profile. Those, however, having ordinary skill in the art will appreciate that any shaped profile may be used in accordance with embodiments disclosed herein, such as within one or more embodiments discussed above.

It should be understood that the present disclosure contemplates having other structures and/or arrangements for an apparatus to inhibit rotation. For example, as shown in the above embodiments, the rotation inhibiting apparatus includes having the first member connected to the second member using multiple types of connections, such as, but not limited to, U-joints, pivots, and linkages. As such, one or more of these connections may enable the first member and/or the second member of the rotation inhibiting apparatus to have axial movement with respect to each other, such as movement in the direction along the vertical axis of the top drive. However, one or more of these connections may substantially inhibit rotation between the first member and the second member. Thus, one or more of these connections, such as a connection between the first member and the top drive, may enable the first member to rotate about one axis of the connection, but not another axis of the connection. However, those having ordinary skill in the art will appreciate that the present application is not so limited, as discussed above, multiple types of connections may be used in accordance with embodiments disclosed herein. Further, the rotation inhibiting apparatus may be disposed at different locations and/or have different arrangements than as shown and discussed above.

Additionally, it should be understood that the present disclosure contemplates a method and/or apparatus to inhibit rotation within a tubular running tool, such as by preventing rotation from occurring between different components of a drilling rig (e.g., the top drive and a portion of the tubular handling mechanism to be retained rotationally stationary). In one or more embodiments, the rotation inhibiting apparatus may be used to transmit torque (e.g., torque about and/or parallel to the rotational axis of the quill of the top drive) between multiple components within a drilling rig, such as between a first component of a drilling rig that is rotationally stationary and a second component of the drilling rig that is to be held rotationally stationary. As such, the rotation inhibiting apparatus may be used to transmit torque (e.g., torque about and/or parallel to the rotational axis of the quill of the top drive) between the first component and the second component of the drilling rig such that the rotation is inhibited from occurring between the first component and the second component of the drilling rig. Where the rotation inhibiting apparatus may be used to transmit torque between the two components of the drilling rig, such as through the connections between the first component and second component of the rotation inhibiting apparatus, this prevents from having resulting tangential forces (e.g., forces occurring about the rotational axis of the top drive and tangential to the connection between the rotation inhibiting apparatus and the tubular handling mechanism) being applied to and across the rotation inhibiting apparatus. Such tangential forces may be significantly greater than that of the torque occurring across the rotation inhibiting apparatus, such as one or more orders of magnitudes greater. For example, in one embodiment, the first member and the second member may be connected to each other such that torque, and substantially only torque, occurring in a direction parallel to a rotational axis of a quill of a top drive is transmitted between a first component of the drilling rig and a second component of the drilling rig. Thus, this may reduce the overall necessary rigidity for a rotation inhibiting apparatus in accordance with embodiments disclosed herein, as the rotation inhibiting apparatus is used to transmit torque between one or more components of the drilling rig.

Further, it should be understood that the present disclosure contemplates a method to manage tubular members within a drilling rig, in which the tubular running tool may be used to transport tubular members within the drilling rig and position a tubular member for making-up and/or breaking-out threaded connections. Furthermore, it should be understood that the present disclosure contemplates using a rotation inhibiting apparatus in accordance with embodiments disclosed herein within one, or multiple, drilling rigs. For example, embodiments disclosed herein provide a rotation inhibiting apparatus that may have movable and/or adjustable parts. As such, the rotation inhibiting apparatus may be provided amongst a variety of drilling rigs and drilling rigs components (e.g., gripping apparatus or other components connected to a quill of a top drive) having multiple shapes and/or sizes to inhibit rotation between the parts within the drilling rig, as the rotation inhibiting apparatus may be movable and adjustable for these shapes and sizes. Further, the rotation inhibiting apparatus may be provided within a drilling rig that incorporates the use of a compensator, such as a thread compensator. In such an embodiment, the thread compensator may enable axial movement, such as movement between a top drive and a tubular member, e.g., a tubular member disposed from the top drive. As such, a rotation inhibiting apparatus in accordance with embodiments disclosed herein may be used to connect to and inhibit rotation between components that are axially moving with respect to each other during the use of the thread compensator, such as between the top drive and the tubular handling mechanism during use of the thread compensator.

Embodiments disclosed herein may provide for one or more of the following advantages. First, embodiments disclosed herein may provide for an apparatus that may be connected to a tubular handling mechanism. As such, the apparatus may inhibit rotation of at least a portion of the tubular handling mechanism, thereby preventing damage to the tubular handling mechanism and/or other components of a drilling rig. Further, embodiments disclosed herein may provide for an apparatus that may increase the efficiency of a drilling rig. For example, the apparatus may decrease the time necessary for making-up and/or breaking-out threaded connections with a string of tubular members, thereby increasing the efficiency of the drilling rig to begin and/or continue drilling.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. An apparatus to inhibit rotation within a drilling rig, comprising:

a first member connected to a first component of the drilling rig;

a second member connected to the first member and connected to a second component of the drilling rig, the second component configured to move vertically with respect to the first component; and a pivoting device to allow the first component to be tilted relative to the second component, wherein the first member is configured to move vertically with respect to the second member, wherein the first member and the second member substantially inhibit rotation between each other, and wherein the first member and the second member are pivotally connected to each other.

2. The apparatus of claim 1, wherein the first component of the drilling rig remains rotationally stationary.

3. The apparatus of claim 1, wherein the first member and the second member are connected to each other such that rotation is substantially inhibited by the connection between the first member and the second member.

4. The apparatus of claim 1, wherein the first member has a first end and a second end and the second member has a first end and a second end, and wherein the second end of the first member is connected to the first end of the second member.

5. The apparatus of claim 4, wherein the first end of the first member is connected to the first component of the drilling rig, and wherein the second end of the second member is connected to a tubular handling mechanism.

6. The apparatus of claim 5, wherein the first end of the first member is connected to a component of a top drive.

7. The apparatus of claim 1, wherein the first member is connected to a component of a top drive.

8. The apparatus of claim 1, wherein the first member is connected to a bail ear of a top drive.

9. The apparatus of claim 1, wherein the second member is connected to a support structure, wherein the support structure is connected to the second component.

10. The apparatus of claim 1, further comprising a support structure having a rotation adjustment system, wherein the rotation adjustment system comprises an adjustment member with a securing mechanism connected thereto, wherein the second member is connected to the support structure and the support structure is connected to the second component of the drilling rig.

11. The apparatus of claim 1, wherein one of the first member and the second member is connected to the first component and the second component of the drilling rig, respectively, using at least one of a pivot and a U-joint.

12. The apparatus of claim 1, wherein at least one of the first member and the second member comprises a pivot for connection.

13. The apparatus of claim 1, wherein the first member and the second member are connected to each other such that torque occurring in a direction parallel to a rotational axis of a quill of a top drive is transmitted between the first component of the drilling rig and the second component of the drilling rig.

14. The apparatus of claim 1, further comprising a third member, wherein the third member is connected between the first member and the second member such that the first member and the second member connect to each other through the third member.

15. The apparatus of claim 14, wherein at least one of the first member, the second member, and the third member comprises a male member, wherein at least another of the first member, the second member, and the third member comprises a female member, and wherein the male member is at least partially disposed within the female member.

16. A system to inhibit rotation within a drilling rig, comprising:

the drilling rig, comprising:

a top drive having a vertical axis defined therethrough; and a tubular handling mechanism supported from a quill of the top drive; and a rotation inhibiting apparatus, comprising:

a first member connected to a rotationally stationary component of the top drive;

a second member connected to the first member and to the tubular handling mechanism; and a pivoting device to allow a first component and a second component of the drilling rig to tilt relative to each other, wherein the first member is movable with respect to the second member in a direction along the vertical axis of the top drive, wherein the first member and the second member are configured to remain rotationally stationary with respect to each other about the vertical axis of the top drive, and wherein the first member has a first end and a second end, wherein the second member has a first end and a second end, wherein the first end of the first member is connected to the top drive, wherein the second end of the first member is connected to the first end of the second member, and wherein the second end of the second member is connected to the tubular handling mechanism.

17. The system of claim 16, wherein the first member connects to a bail ear of the top drive.

18. An apparatus to inhibit rotation of a component connected to a top drive, comprising:

a first member and a second member connected to each other;

wherein the first member and the second member connect between a component of a drilling rig, the component of the drilling rig remaining rotationally stationary with respect to an axis of the top drive, and a component connected to a quill of the top drive, wherein a pivoting device is configured to allow tilting of at least one of the component of the drilling rig and the component connected to the quill of the top drive with respect to each other, wherein at least one of the first member and the second member is configured to move vertically with respect to the drilling rig, wherein the first member and the second member are configured to remain rotationally stationary with respect to each other about the axis of the top drive, and wherein the first member has a first end and a second end and the second member has a first end and a second end, and wherein the second end of the first member is connected to the first end of the second member.

19. A method to inhibit rotation within a drilling rig, the method comprising:

coupling a first member of a rotation inhibiting apparatus to a first component of the drilling rig;

coupling a second member of the rotation inhibiting apparatus to a second component of the drilling rig, the second component configured to move vertically with respect to the first component and configured to rotate with respect to the first component;

connecting the first member and the second member of the rotation inhibiting apparatus to each other such that the first member is able to move vertically with respect to the second member within the drilling rig and the first member and the second member substantially inhibit rotation between each other; and tilting, by a pivoting device, at least one of the first component and the second component with respect to each other, wherein the first member and the second member are pivotally connected to each other.

20. The method of claim 19, further comprising:

engaging a tubular member with a tubular handling mechanism;

engaging the tubular member with at least one gripping member of a tubular running tool; and rotating the tubular member with a top drive operatively connected to the tubular running tool.

21. The method of claim 19, further comprising:

moving the top drive and the tubular running tool with respect to each other along an axis of the tubular running tool.

22. The method of claim 21, wherein a thread compensator is used to move the tubular running tool and the top drive with respect to each other.

23. The method of claim 20, wherein the tubular handling mechanism engages an outer diameter of the tubular member.

24. A method to at least one of make-up and break-out a threaded connection with a string of tubular members, the method comprising:

rotating a tubular member with respect to the string of tubular members with a tubular running tool;

moving a first member of a rotation inhibiting apparatus with respect to a second member of the rotation inhibiting apparatus along an axis of the tubular running tool, the rotation inhibiting apparatus being coupled between a tubular handling mechanism and a component of a drilling rig; and tilting, by a pivoting device, the tubular handling mechanism with respect to the component of the drilling rig, wherein the first member and the second member are pivotally connected to each other.

25. The method of claim 24, wherein the rotating the tubular with respect to the string of tubular members comprises one of:

making-up the threaded connection between the tubular member and the string of tubular members; and breaking-out the threaded connection between the tubular member and the string of tubular members.

26. The method of claim 24, wherein the rotation inhibiting apparatus is connected to a component of a top drive of the drilling rig, the component of the top drive remaining rotationally stationary with respect to the axis of the tubular running tool.

27. The method of claim 24, wherein the tubular running tool comprises a top drive to rotate the tubular member with respect to the string of tubular members.

28. An apparatus to inhibit rotation within a drilling rig, comprising:

a first member having a first end and a second end;

the first end of the first member connected to at least one bail ear of a top drive of the drilling rig;

the second end of the first member connected to a first component rotationally connected to a quill of the top drive;

a second member; and a pivoting device to allow at least one of the top drive and the first component rotationally connected to the quill of the top drive to tilt with respect to each other, wherein one of the first member and the second member is connected to the first component and a second component of the drilling rig, respectively, using at least one of a pivot and a U-joint.

29. The apparatus of claim 28, wherein the first component comprises a sub, wherein the sub is rotationally connected to the quill of the top drive.

30. A method to inhibit rotation within a drilling rig, the method comprising:

coupling a first end of a first member of a rotation inhibiting apparatus to at least one bail ear of a top drive of the drilling rig;

coupling a second end of the first member of the rotation inhibiting apparatus to a component rotationally coupled to a quill of the top drive of the drilling rig; and tilting, by a pivoting device, at least one of the top drive and the component rotationally coupled to the quill of the top drive with respect to one another, wherein the quill is configured to rotate about a rotational axis of the top drive, wherein at least one of the first member and a second member comprises a pivot for connection.

31. The method of claim 30, wherein the second end of the member of the rotation inhibiting apparatus is coupled to a sub, wherein the sub is rotationally coupled to the quill of the top drive.

32. An apparatus to allow tilting between components of a drilling rig, comprising:

a first member having a first end and a second end;

a second member;

a pivoting device;

the first end of the first member connected to a first component of the drilling rig;

the second end of the first member connected to the pivoting device, the pivoting device connected to a second component of the drilling rig; and a third member, wherein the third member is connected between the first member and the second member such that the first member and the second member connect to each other through the third member, wherein the pivoting device allows at least one of the first component and the second component to tilt with respect to each other.

33. A method to inhibit rotation within a drilling rig, the method comprising:

coupling a first end of a first member of a rotation inhibiting apparatus to a first component of the drilling rig;

coupling a second end of the first member of the rotation inhibiting apparatus to a pivoting device;

coupling the pivoting device to a second component of the drilling rig; and tilting, by the pivoting device, at least one of the first component and the second component with respect to each other, wherein the first member and a second member are pivotally connected to each other.

34. The method of claim 33, wherein the second component comprises a sub.

* * * * *